US012710194B2

(12) United States Patent
Jeung et al.

(10) Patent No.: US 12,710,194 B2
(45) Date of Patent: Aug. 18, 2026

(54) BAFFLE SYSTEM FOR TERMINAL UNIT

(71) Applicant: Air Distribution Technologies IP, LLC, Milwaukee, WI (US)

(72) Inventors: Wah Gwain Jeung, Richardson, TX (US); Brandon Michael Helms, Garland, TX (US); Steven James Purdie, Allen, TX (US); Brian S. Redford, Richardson, TX (US); Timothy Chad Huggins, Parker, TX (US); Michael Zachary Taylor, McKinney, TX (US); Timothy Tyler Crane, Princeton, TX (US)

(73) Assignee: Air Distribution Technologies IP, LLC, Milwaukee, WI (US)

( * ) Notice: Subject to any disclaimer, the term of this patent is extended or adjusted under 35 U.S.C. 154(b) by 643 days.

(21) Appl. No.: 17/831,327

(22) Filed: Jun. 2, 2022

(65) Prior Publication Data

US 2022/0390142 A1 Dec. 8, 2022

Related U.S. Application Data

(60) Provisional application No. 63/196,114, filed on Jun. 2, 2021.

(51) Int. Cl.
*F24F 13/08* (2006.01)

(52) U.S. Cl.
CPC ..... *F24F 13/08* (2013.01)

(58) Field of Classification Search
CPC .. F14F 13/08; F14F 13/20; F14F 13/24; F24F 2013/242; B04B 1/82
See application file for complete search history.

(56) References Cited

U.S. PATENT DOCUMENTS 3,455,378 A 7/1969 Honnold, Jr.
3,511,162 A * 5/1970 Truhan ..... F24F 9/00 454/189
3,712,846 A * 1/1973 Daniels ..... E04B 1/86 428/401
3,750,839 A 8/1973 Mcnabney
3,885,462 A * 5/1975 Krook ..... F24F 13/06 362/218
3,911,958 A 10/1975 Logsdon
4,203,485 A 5/1980 Zilbermann et al.
4,418,719 A 12/1983 Downs, Jr. et al.
(Continued)

FOREIGN PATENT DOCUMENTS

GB 1557534 A * 12/1979 ..... E06B 7/02
WO WO-2015135025 A2 * 9/2015 ..... F24F 1/01

OTHER PUBLICATIONS

Price, "Fan Powered Terminal Units—FDC, FPC Series—Constant Volume Series Flow", 2014, 36 pages, Price Industries Limited.
(Continued)

*Primary Examiner* — Steven B McAllister
*Assistant Examiner* — Michael James Giordano

(57) ABSTRACT

A baffle system for a terminal unit of a heating, ventilation, and air conditioning (HVAC) system includes a baffle configured to be disposed within the terminal unit and to receive and extend about an inlet duct of the terminal unit, where the baffle comprises a panel and an insulation layer coupled to the panel.

19 Claims, 11 Drawing Sheets

(56) References Cited

U.S. PATENT DOCUMENTS

2023/0042007 A1* 2/2023 Mikkonen ..... F24F 11/33

OTHER PUBLICATIONS

Warren Technology, "Quiet Plus VAV Terminal Units", 2018, 4 pages, https://www.warrenhvac.com/products/quiet-plus-vav-terminal-units/.

Peng Yin, "Modeling of ECM Controlled Series Fan-Powered VAV Terminal Units"—A Thesis Submitted to the Office of Graduate Studies of Texas A&M University, Aug. 2010, 226 pages.

Nailor Industries Inc., Fan Powered Terminals, Oct. 2017, pp. D1-D108, https://www.gmamco.ae/uploads/2017/10/VAV_Fan-Powered.pdf.

* cited by examiner

BAFFLE SYSTEM FOR TERMINAL UNIT

CROSS-REFERENCE TO RELATED APPLICATION

This application claims priority from and the benefit of U.S. Provisional Application No. 63/196,114, entitled "BAFFLE SYSTEM FOR TERMINAL UNIT," filed Jun. 2, 2021, which is herein incorporated by reference in its entirety for all purposes.

BACKGROUND

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Heating, ventilation, and air conditioning (HVAC) systems are utilized in residential, commercial, and industrial applications to control environmental properties, such as temperature and humidity, for occupants of respective environments. An HVAC system may control the environmental properties through control of properties of an air flow delivered to and ventilated from spaces serviced by the HVAC system. For example, the HVAC system may transfer heat between the air flow and refrigerant flowing through the system (e.g., a heat exchanger) to provide cooled air for an indoor environment. Similarly, the HVAC system may heat the air flow to provide heating to the indoor environment. In some situations, the HVAC system may provide cooling of the air flow followed by heating of the air flow to reduce humidity while providing air at a desired temperature to the indoor environment. The HVAC system may also control a flowrate of the air flow to manage (e.g., expedite transitioning between) environmental conditions.

Terminal units, which may also be referred to as variable air volume (VAV) systems, may be part of an HVAC system. Some buildings utilize terminal units to control air distribution. That is, terminal units coordinate with other air conditioning components (e.g., an air handling system) of the HVAC system to facilitate supply of conditioned air to various different locations or zones (e.g., separate rooms or areas within a building). Terminal units may be positioned in and/or adjacent to various floors or rooms of a building. For example, in some applications, terminal units may be located within a dropped ceiling of an area or room of a building. As a result, terminal units may be located near occupants within the building. Unfortunately, existing terminal units may generate and output undesirable noise that may be heard by occupants of the building.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a baffle system for a terminal unit of a heating, ventilation, and air conditioning (HVAC) system includes a baffle configured to be disposed within the terminal unit and to receive and extend about an inlet duct of the terminal unit, where the baffle comprises a panel and an insulation layer coupled to the panel.

In another embodiment, a terminal unit of a heating, ventilation, and air conditioning (HVAC) system includes a housing having a plurality of housing panels defining an internal volume, an inlet duct extending through a housing panel of the plurality of housing panels and into the internal volume, where the inlet duct is configured to direct an air flow into the internal volume, and a baffle system disposed within the internal volume, wherein the baffle system includes a baffle including a panel and an insulation layer coupled to the panel.

In a further embodiment, a terminal unit of a heating, ventilation, and air conditioning (HVAC) system includes a housing having a plurality of housing panels defining an internal volume, an inlet duct extending through a first housing panel of the plurality of housing panels and into the internal volume, where the inlet duct is configured to direct a first air flow into the internal volume, and an opening formed in a second housing panel of the plurality of housing panels, where the opening is configured to direct a second air flow into the internal volume. The terminal unit also includes a baffle system disposed within the internal volume, where the baffle system includes a first baffle coupled to the inlet duct and extending about the inlet duct and a second baffle coupled to the first housing panel and the first baffle.

BRIEF DESCRIPTION OF THE DRAWINGS

Various aspects of the present disclosure may be better understood upon reading the following detailed description and upon reference to the drawings, in which.

DETAILED DESCRIPTION

Figure 1:
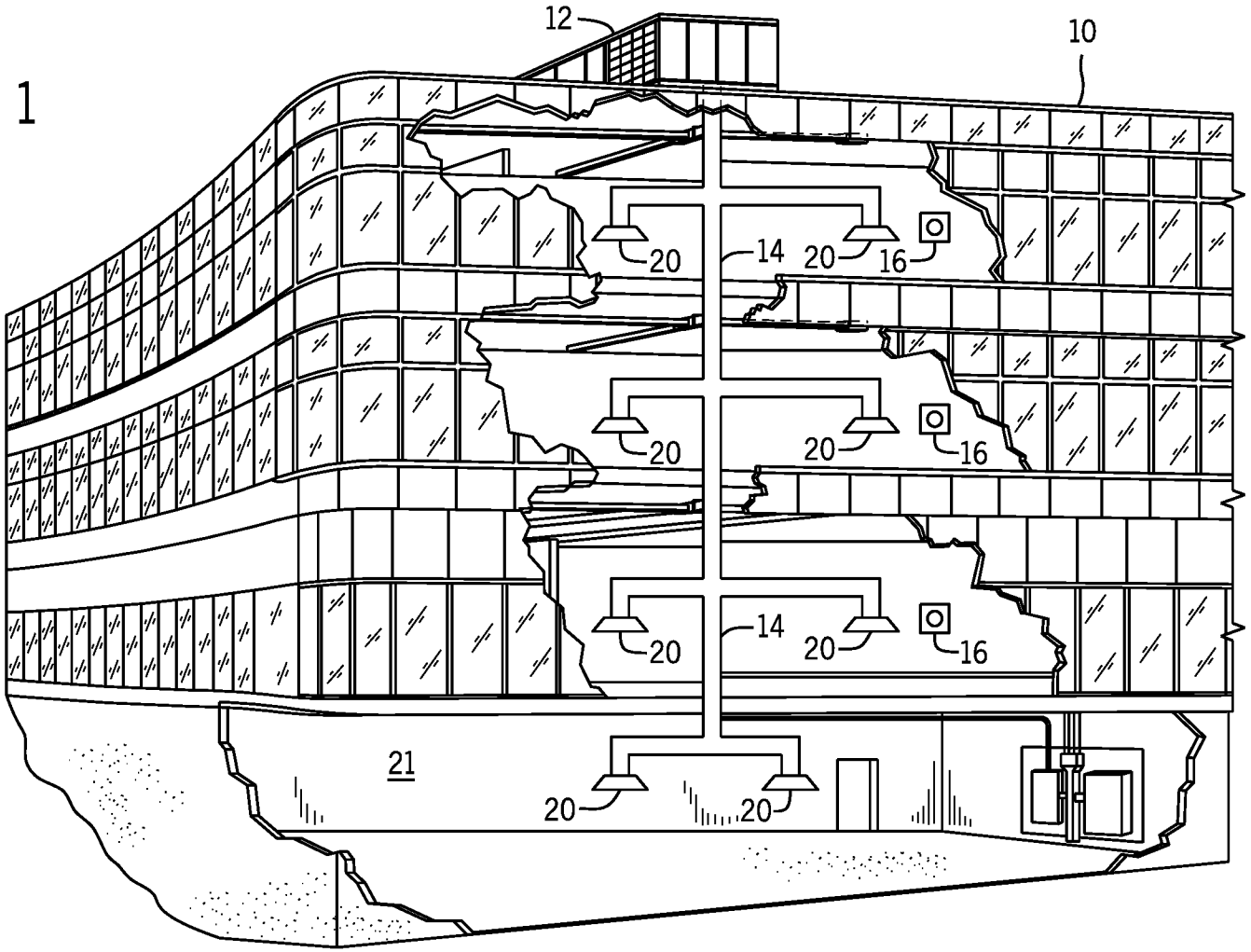
FIG. 1 is a perspective view of an embodiment of a building that utilizes a heating, ventilation, and/or air conditioning (HVAC) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure is directed to various features of a terminal unit of a commercial, industrial, or residential heating, ventilation, and air conditioning (HVAC) system. In particular, the present disclosure is directed to a baffle system (e.g., internal baffle system) of a terminal unit that is configured to reduce an amount of sound output by the terminal unit during operation of the terminal unit.

HVAC systems are generally configured to provide conditioned air to an internal space. In certain systems, an air flow (e.g., a conditioned airflow, primary air flow) may be provided to a number of terminal units positioned in various rooms or on various floors of a building. The terminal units may be positioned within a conditioned space serviced by the HVAC system or may be positioned adjacent the conditioned space, such as within a dropped ceiling of a room or floor (e.g., level) of the building. The air flow supplied to the terminal units may be conditioned via a rooftop unit (RTU), a boiler, a chiller, an air handling unit, the terminal unit, or any combination thereof. Other conditioning systems, structures, or configurations are also possible. In general, each terminal unit is configured to distribute the conditioned air flow to the room(s) and/or floor(s) associated with the terminal unit. In some embodiments, the terminal unit may also receive an additional air flow, such as induced air flow, plenum air flow, and/or return air flow. In such embodiments, the terminal unit may combine the conditioned air flow with the additional air flow to form a supply air flow, and the supply air flow may be discharged by the terminal unit toward a conditioned space (e.g., a room or space associated with the terminal unit).

As used herein, the terms "approximately," "generally," "substantially," and so forth, are intended to convey that the property value being described may be within a relatively small range of the property value, as those of ordinary skill would understand. For example, when a property value is described as being "approximately" equal to (or, for example, "substantially similar" to) a given value, this is intended to convey that the property value may be within +/−5%, within +/−4%, within +/−3%, within +/−2%, within +/−1%, or even closer, of the given value. Similarly, when a given feature is described as being "substantially parallel" to another feature, "generally perpendicular" to another feature, and so forth, this is intended to convey that the given feature is within +/−5%, within +/−4%, within +/−3%, within +/−2%, within +/−1%, or even closer, to having the described nature, such as being parallel to another feature, being perpendicular to another feature, and so forth. Mathematical terms, such as "parallel" and "perpendicular," should not be rigidly interpreted in a strict mathematical sense, but should instead be interpreted as one of ordinary skill in the art would interpret such terms. For example, one of ordinary skill in the art would understand that two lines that are substantially parallel to each other are parallel to a substantial degree, but may have minor deviation from exactly parallel.

As mentioned above, the terminal unit may generate noise during operation. For example, the one or more air flows directed through the terminal unit may generate noise and/or components of the terminal unit (e.g., a blower) may generate noise, which may be output by the terminal unit. In some instances, the noise generated and output by the terminal unit may be detectable (e.g., heard) by occupants of the space conditioned by the terminal unit, which may be undesirable. It therefore may be desirable to reduce noise output by the terminal unit during operation.

Accordingly, present embodiments are directed to a baffle system (e.g., internal baffle system) configured to be disposed within a terminal unit. As discussed below, the baffle system may include a plurality of baffles configured to attenuate sound generated by the terminal unit during operation of the terminal unit and to reduce output of sound generated by the terminal unit. For example, the baffle system may include a baffle arranged or disposed about an inlet duct of the terminal unit that is configured to receive an air flow, such as a primary air flow or conditioned air flow. The baffle system may also include additional baffles (e.g., sheets, panels) that may be perforated to facilitate air flow through the baffle system and the terminal unit while attenuating or reducing noise generated or output by the terminal unit. Additionally, one or more of the baffles may include one or more insulation layers (e.g., sound absorption layers, sound deadening layers) to reduce noise output during operation of the terminal unit. In this way, the present embodiments enable a reduction in noise output by the terminal unit while also enabling a desired rate of air flow through the terminal unit.

Turning now to the drawings, FIG. 1 illustrates a heating, ventilating, and air conditioning (HVAC) system for building environmental management that may employ one or more HVAC units. In the illustrated embodiment, a building 10 is air conditioned by a system that includes an HVAC unit 12. The building 10 may be a commercial structure or a residential structure. As shown, the HVAC unit 12 is disposed on the roof of the building 10. However, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. Outdoor units or other conditioning schemes are also possible. After the HVAC unit 12 conditions the air, the air is supplied to the building 10 via ductwork 14 extending throughout the building 10 from the HVAC unit 12. For example, the ductwork 14 may extend to various individual floors or other sections, such as rooms, of the building 10. Terminal units 20 associated with the floors, rooms, or other sections of the building 10 may be connected to the ductwork 14 and may be configured to distribute the air flow to the floors, rooms, or other sections of the building 10. In some embodiments, the terminal units 20 may include air conditioning features in addition to, or instead of, the air conditioning features of the HVAC unit 12.

In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air flow and a furnace for heating the air flow. Additionally or alternatively, other HVAC equipment may be installed at the terminal units 20 or in another area of the building, such as a basement 21 (e.g., a boiler may be installed in the basement 21). A control device 16, one type of which may be a thermostat, may be used to designate the temperature of the conditioned air. The control device 16 also may be used to control the flow of air from the HVAC unit 12, through the ductwork 14, to the terminal units 20, or any combination thereof. For example, the control device 16 may be used to regulate operation of one or more components of the HVAC unit 12 and/or terminal units 20. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
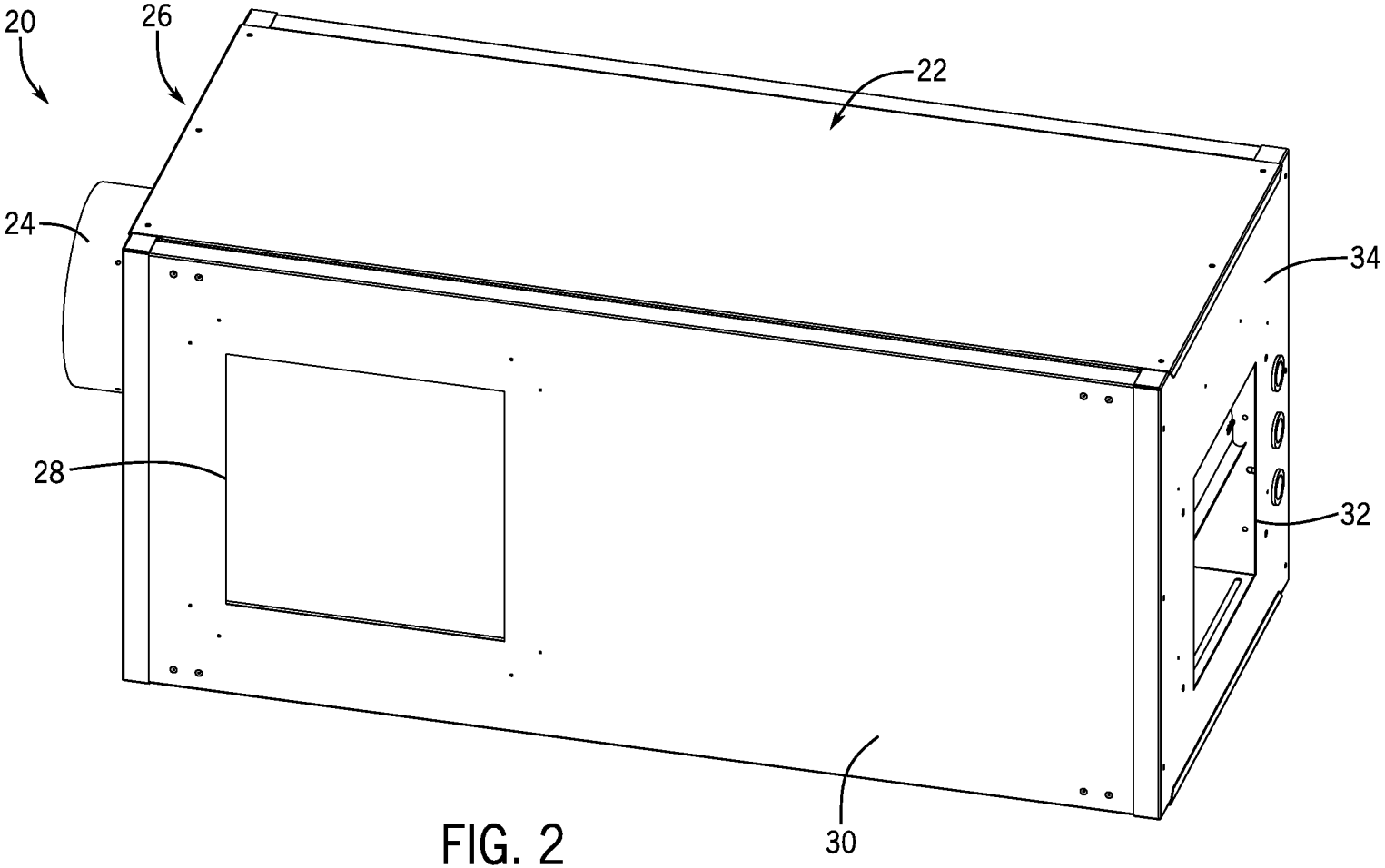
FIG. 2 is a schematic perspective view of an embodiment of a terminal unit that may be utilized in an HVAC system, in accordance with an aspect of the present disclosure.

FIG. 2 is a perspective view schematic of an embodiment of the terminal unit 20 that may be utilized with an HVAC system. As shown, the terminal unit 20 may include a housing 22 (e.g., a casing, a shell, an enclosure) that defines an interior volume of the terminal unit 20 and separates the internal volume from an exterior environment. The housing 22 may be formed via one or more panels, which may be constructed from sheet metal or another suitable material. In some embodiments, the housing 22 of the terminal unit 20 may be positioned within a dropped ceiling adjacent to a conditioned space (e.g., a room) serviced by an HVAC system having the terminal unit 20.

The housing 22 may include one or more openings configured to intake or discharge air flow. For example, the illustrated embodiment of the housing 22 includes an inlet duct 24 (e.g., a primary air inlet, inlet conduit), which may extend to and/or through an inlet panel 26 (e.g., side, end, inlet panel, inlet side, housing panel) of the housing 22. That is, the inlet panel 26 of the housing 22 may include an opening or aperture, and the inlet duct 24 may extend to and/or through the opening of the inlet panel 26. In some embodiments, the inlet duct 24 may be formed via separate and/or discontinuous elements, such as a conduit disposed external to the housing and an additional element (e.g., conduit, structure) disposed within the housing 22. The inlet duct 24 may be configured to receive a conditioned air flow (e.g., primary air flow), such as from an air handler or other central HVAC unit or system, and direct the conditioned air flow into the internal volume of the housing 22. The inlet duct 24 may have any suitable shape or cross-sectional geometry, such as a circular, rectangular, or other suitable geometry. In some embodiments, the inlet duct 24 may be fluidly coupled to ductwork or other conduit configured to direct air flow from an HVAC unit or air handling unit to the inlet duct 24 and into the housing 22.

In addition to the inlet duct 24, the housing 22 may include a side inlet 28 (e.g., opening, induced air opening, induced air inlet) formed in a side panel 30 of the housing 22. As shown, the side panel 30 may be coupled to and may extend crosswise from the inlet panel 26. The side inlet 28 is configured to receive an air flow and direct the air flow into the internal volume of the housing 22. In some embodiments, return air from a conditioned space may flow through the side inlet 28 and into the housing 22 during operation of the terminal unit 20. For example, in some applications the terminal unit 20 may be disposed within a dropped ceiling or other plenum space, and return air (e.g., plenum air) within the dropped ceiling may flow into the housing 22 of the terminal unit 20 via the side inlet 28. The side inlet 28 may be an opening having any suitable geometry, such as a circle, square, rectangle, or other polygonal shape.

The housing 22 may also include an outlet 32 (e.g., opening, discharge port) configured to discharge air flow from within the housing 22 and toward a conditioned space. In the illustrated embodiment, the outlet 32 is formed in an outlet panel 34 of the housing 22, which is disposed opposite the inlet panel 26 (e.g., relative to the internal volume defined by the housing 22). However, in other embodiments, the outlet 32 may be formed in another suitable portion of the housing 22. As described in further detail below, the outlet 32 may discharge air flow received by the housing 22 via the inlet duct 24, the side inlet 28, or both. The air flow discharged via the outlet 32 may be directed to the conditioned space serviced by the terminal unit 20, such as via ductwork and/or a diffuser.

Figure 3:
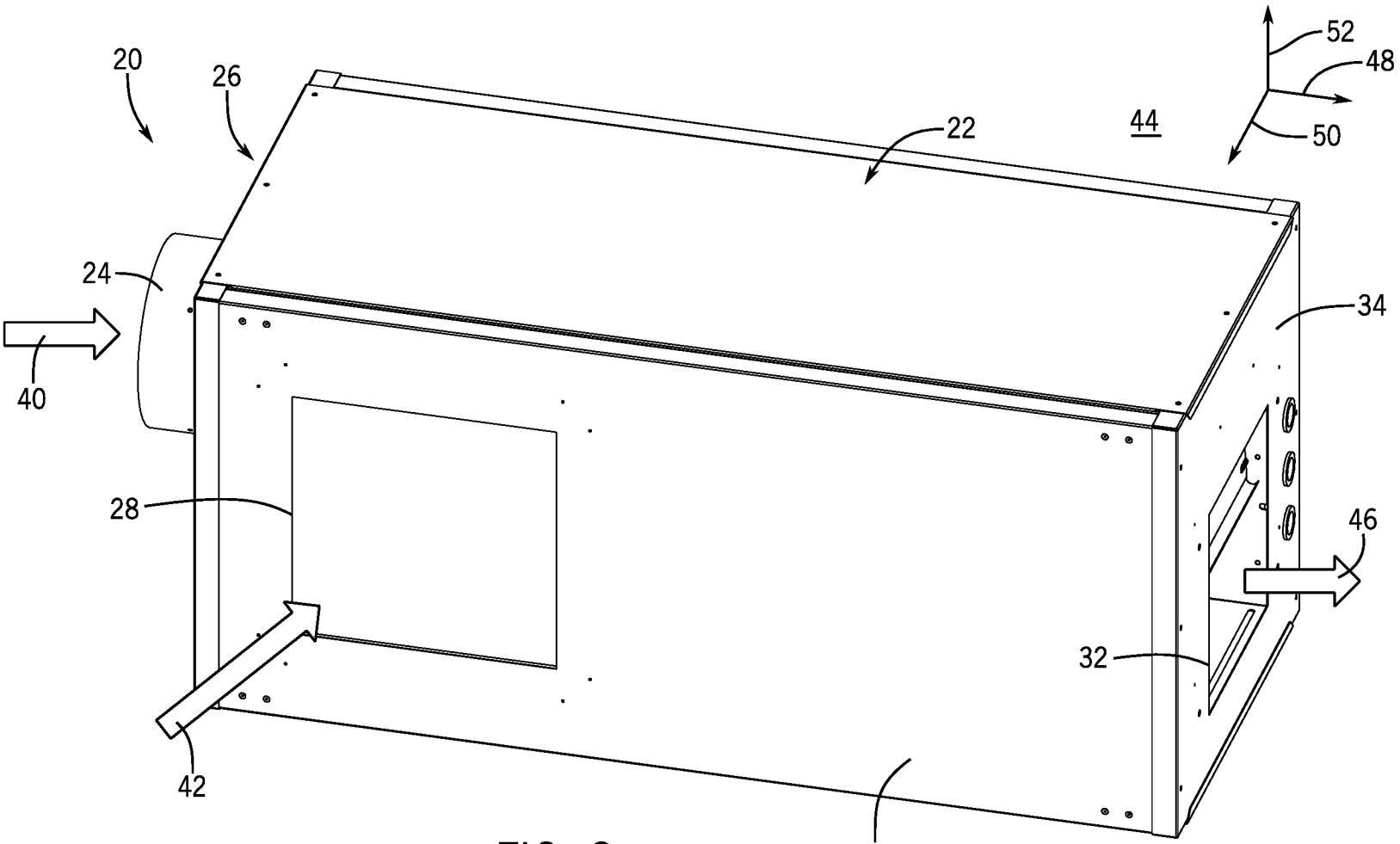
FIG. 3 is a schematic perspective view of an embodiment of a terminal unit that may be utilized in an HVAC system, illustrating air flow through the terminal unit, in accordance with an aspect of the present disclosure.

FIG. 3 is a perspective view schematic of an embodiment of the terminal unit 20, illustrating air flow into and out of the terminal unit 20. As mentioned above, the terminal unit 20 may receive a primary air flow 40 (e.g., conditioned air flow) via the inlet duct 24 extending to and/or into the housing 22 of the terminal unit 20. In some embodiments, the primary air flow 40 may be supplied by an HVAC unit (e.g., central HVAC unit, rooftop unit), air handling unit (e.g., air handler), or other air conditioning system. Thus, the primary air flow 40 may be a conditioned air flow (e.g., cooled air flow, heated air flow, dehumidified air flow, filtered air flow), in some embodiments. The terminal unit 20 may also receive an induced air flow 42 via the side inlet 28. For example, the induced air flow 42 may be a return air flow received from a conditioned space. In some embodiments, flow of the induced air flow 42 is induced via operation of the terminal unit 20. In particular, as the primary air flow 40 is directed into and through the terminal unit 20, a pressure differential between the internal volume of the terminal unit 20 and an exterior environment 44 surrounding the terminal unit 20 may cause the induced air flow 42 to flow into the terminal unit 20 via the side inlet 28. In some embodiments, the induced air flow 42 may be drawn into the housing 22 by a flow generating device (e.g., a blower) of the terminal unit 20. The primary air flow 40 and the induced air flow 42 may combine or mix with one another within the housing 22 and may be discharged from the terminal unit 20 via the outlet 32 formed in the housing 22. Specifically, the primary air flow 40 and/or the induced air flow 42 may be discharged from the terminal unit 20 as a supply air flow 46 (e.g., outlet air flow). The supply air flow 46 may be directed to the space conditioned by the terminal unit 20. As will be appreciated, respective amounts (e.g., flow rates) of primary air flow 40 and induced air flow 42 directed into the terminal unit 20 may be adjusted or controlled in order to adjust one or more parameters (e.g., flow rate, temperature) of the supply air flow 46 discharged from terminal unit 20. For example, the terminal unit 20 and/or other the HVAC system including the terminal unit 20 may include one or more dampers, valves, panels, blowers, fans, or other flow control devices that are adjustable to control flow of the primary air flow 40 and/or induced air flow 42 into the terminal unit 20.

To facilitate the following discussion, the terminal unit 20 and components of (e.g., within) the terminal unit 20 may be described with reference to a longitudinal axis 48, a lateral axis 50, and a vertical axis 52, which is oriented relative to gravity. For example, in the illustrated embodiment, the primary air flow 40 is directed into the housing 22 of the terminal unit 20 via the inlet duct 24 along the longitudinal axis 48. The induced air flow 42 is directed into the housing 22 of the terminal unit 20 at least partially along the lateral axis 50, and the supply air flow 46 is discharged from the housing 22 via the outlet 32 along the longitudinal axis 48.

As the primary air flow 40 and/or the induced air flow 42 are directed into the housing 22 and through the terminal unit 20 to the outlet 32, sound or noise may be generated. Additionally, sound or noise may be generated via operation of components (e.g., a blower) of the terminal unit 20. Noise generated within the terminal unit 20 (e.g., within the housing 22) may be discharged from the terminal unit 20, such as via the side inlet 28, the outlet 32, the inlet duct 24, and/or via panels of the housing 22 (e.g., vibration of the housing 22). In accordance with present embodiments, the terminal unit 20 includes a baffle system (e.g., internal baffle system, internal baffles) disposed within the housing 22 that is configured to attenuate sounds or noise emitted or discharged from the terminal unit 20 during operation of the terminal unit 20. For example, the baffle system may include one or more baffles having a construction and/or arrangement within the housing 22 that is configured to reduce an amount of sound that is emitted from the terminal unit 20. Details of the baffle system are described in further detail below.

Figure 4:
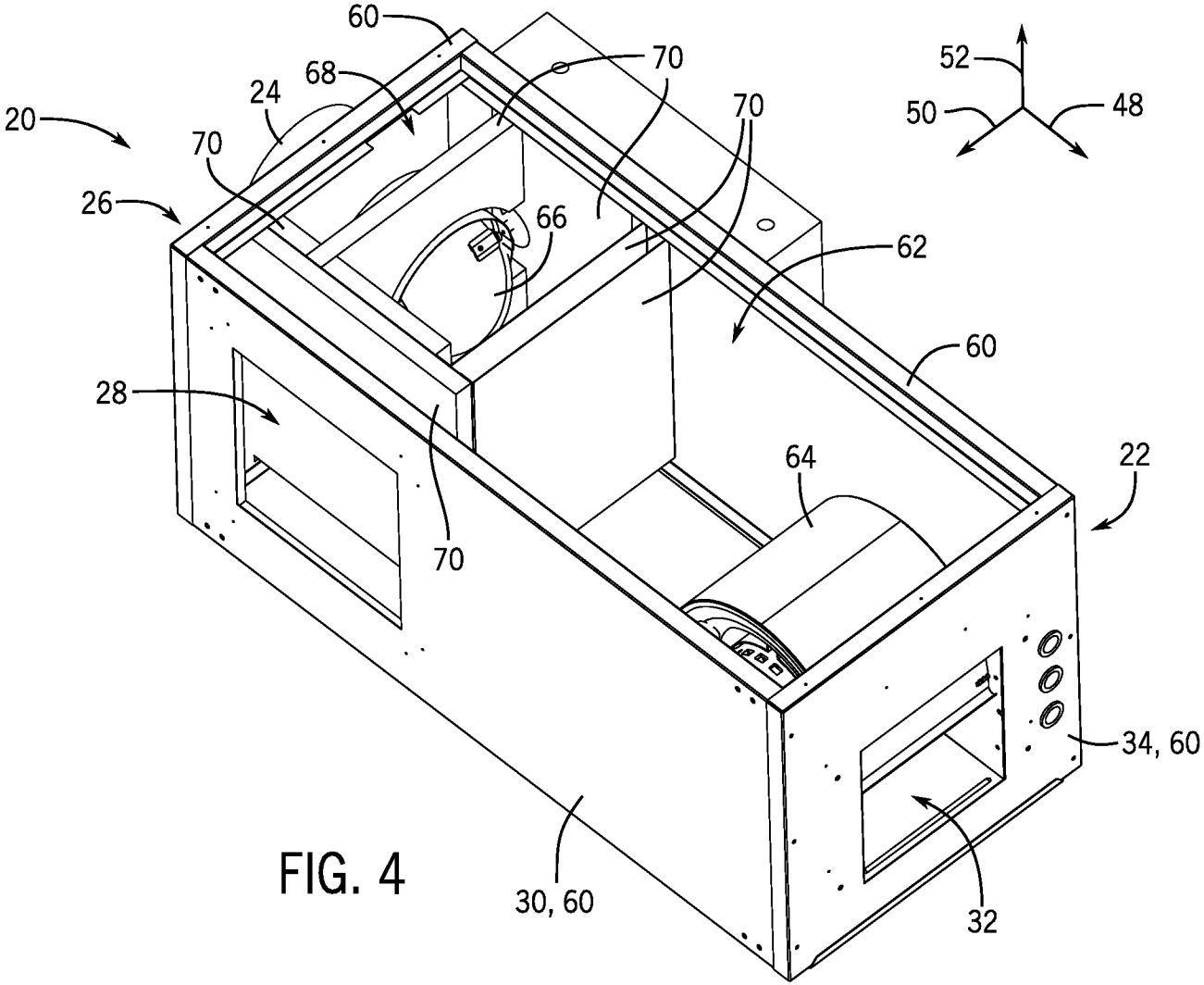
FIG. 4 is a perspective view of an embodiment of a terminal unit, illustrating a baffle system of the terminal unit, in accordance with an aspect of the present disclosure.

FIG. 4 is a perspective view of an embodiment of the terminal unit 20, illustrating internal components of the terminal unit 20. As mentioned above, the housing 22 of the terminal unit 20, which may be formed via a plurality of panels 60 (e.g., housing panels, body panels) assembled or secured to one another, defines an interior volume 62 within which internal components of the terminal unit 20 may be disposed. For example, the terminal unit 20 includes a blower 64 disposed within the housing 22 (e.g., within the internal volume 62 of the housing 22). The blower 64 may operate to draw air flow (e.g., primary air flow 40, induced air flow 42, etc.) into the interior volume 62 and to discharge air flow (e.g., supply air flow 46) out of the terminal unit 20 via the outlet 32. In some embodiments, the terminal unit 20 includes a damper 66 configured to regulate the primary air flow 40 directed into the terminal unit 20. Specifically, the damper 66 may be fluidly coupled to (e.g., disposed within) the inlet duct 24, and a position of the damper 66 may be regulated or adjusted to control a flow rate of the primary air flow 40 directed into the housing 22.

In the illustrated embodiment, the terminal unit 20 also includes a baffle system 68 disposed within the housing 22. The baffle system 68 is configured to reduce an amount of noise or sound emitted from the terminal unit 20 during operation of the terminal unit 20. For example, the baffle system 68 may be configured to attenuate, absorb, or otherwise block transmission of sound (e.g., acoustic waves) from the terminal unit 20 (e.g., via the side inlet 28, via the outlet 32, via the panels 60, and so forth). As shown, the baffle system 68 includes one or more baffles 70 disposed within the internal volume 62 of the housing 22. The one or more baffles 70 are arranged within the internal volume 62 in a manner that blocks transmission of sound or noise from the terminal unit 20 (e.g., adjacent or about the inlet duct 24). The one or more baffles 70 may also include features that reduce transmission of sound from the terminal unit 20. Details of individual baffles 70 and the arrangement of baffles 70 within the terminal unit 20 are described in further detail below.

Figure 5:
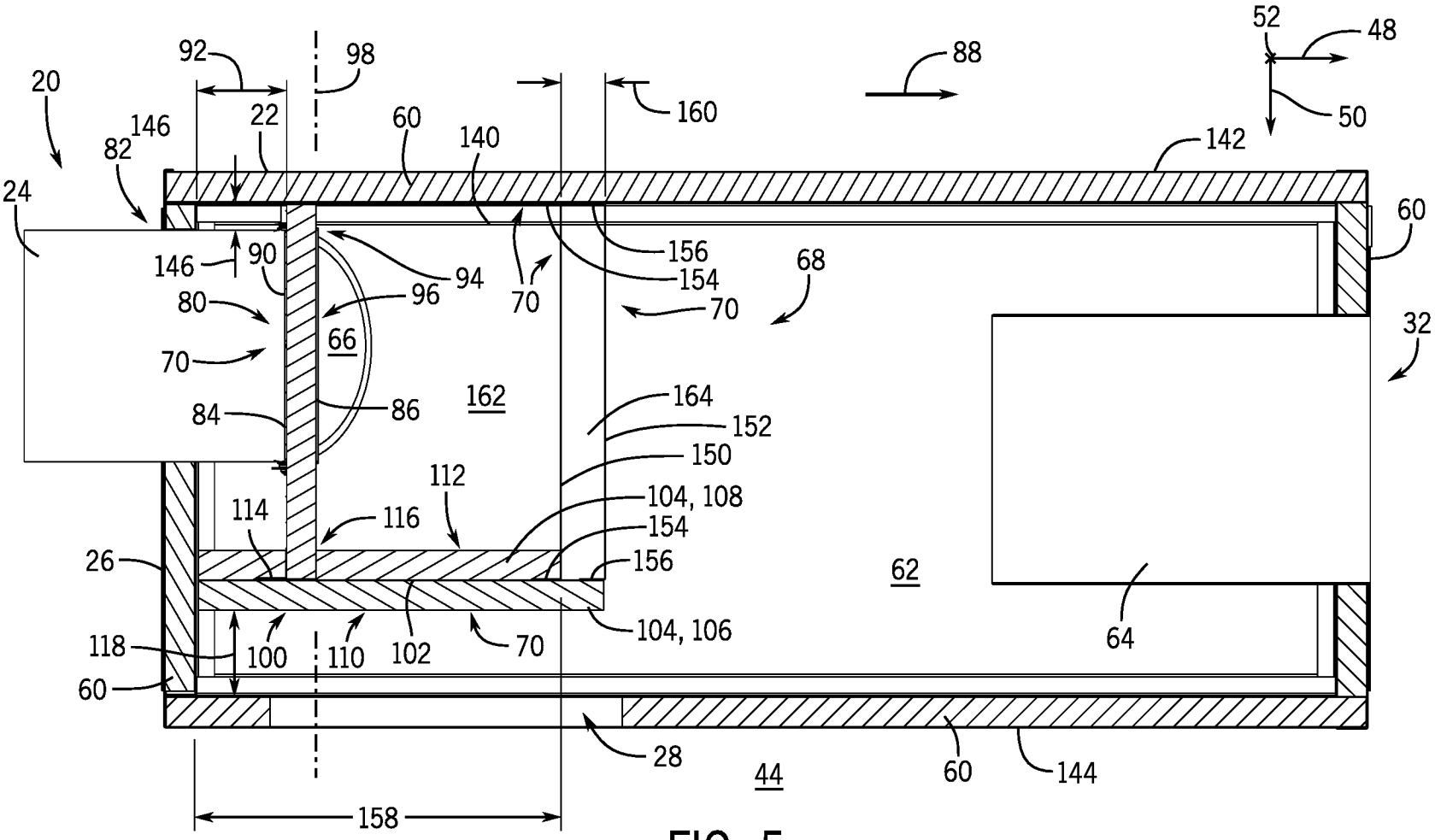
FIG. 5 is a schematic top view of an embodiment of a terminal unit, illustrating a baffle system of the terminal unit, in accordance with an aspect of the present disclosure.

FIG. 5 is a top view schematic of an embodiment of the terminal unit 20, illustrating an embodiment of the baffle system 68 disposed within the internal volume 62 of the housing 22. As mentioned above, the baffle system 68 includes the plurality of baffles 70 disposed within the internal volume 62. The baffles 70 are arranged within the internal volume 62 to reduce transmission of sound (e.g., acoustic waves) from the terminal unit 20. For example, the baffles 70 are arranged to attenuate sound generated within the housing 22 and to reduce emission of sound from the housing 22.

In the illustrated embodiment, the plurality of baffles 70 includes a first baffle 80 disposed about the inlet duct 24 of the terminal unit 20. As mentioned above, the inlet duct 24 may extend through the housing 22 via an opening 82 formed in the inlet panel 26 of the housing 22. The inlet duct 24 may also extend at least partially into an opening formed in the first baffle 80. In other words, the first baffle 80 may be disposed about (e.g., surround) the inlet duct 24. To this end, the opening 82 formed in the first baffle 80 may have a geometry or shape that generally corresponds to a geometry or shape (e.g., outer perimeter, outer diameter) of the inlet duct 24. For example, the inlet duct 24 may have a generally circular cross-section, and the first baffle 80 may have a generally circular opening (e.g., opening 82) formed therein that is configured to receive the inlet duct 24. Accordingly, in an assembled configuration of the baffle system 68 with the terminal unit 20, the first baffle 80 may extend generally about (e.g., encircle, encompass, surround) the inlet duct 24.

The first baffle 80 may include a panel 84 (e.g., structural panel, sheet, first panel, solid metal sheet, baffle panel) and an insulation layer 86 (e.g., sound absorption layer, material, or sheet, sound deadening layer, material, or sheet) coupled to the panel 84. In some embodiments, the panel 84 may be a solid (e.g., non-perforated, non-porous) layer of sheet metal. As used herein, "perforated" may refer to a configuration of a panel having a plurality of openings or holes formed therein, whereby the openings or holes are arrayed substantially across two dimensions (e.g., a height and a width) of the panel. "Non-perforated" may refer to a configuration of a panel that does not have a plurality of openings or holes arrayed substantially across two dimensions (e.g., a height and a width) of the panel. For example, a non-perforated panel may be a substantially solid and/or non-porous sheet. The insulation layer 86 may be formed from any suitable material, such as foam, fiberglass, a dual-density insulative material, or other suitable insulating material (e.g., sound absorbing material) configured to absorb and/or reduce transmission of acoustic waves, vibrations, sound, noise, and so forth. However, in some embodiments, the first baffle 80 may not include the insulation layer 86. The insulation layer 86 may have any suitable thickness (e.g., dimension extending along longitudinal axis 48 in the illustrated embodiment). For example, the insulation layer 86 may have a thickness of approximately one inch or one-half inch. Further, the insulation layer 86 may be secured to the panel 84 via any suitable technique, such as pin welds or an adhesive.

In an installed configuration of the first baffle 80, the panel 84 may generally face the inlet panel 26 of the housing 22, and the insulation layer 86 may generally face the internal volume 62 of the housing 22. In other words, the panel 84 may face a generally upstream direction (e.g., relative to a direction 88 of primary air flow 40 through the terminal unit 20), and the insulation layer 86 may face a generally downstream direction (e.g., relative to the direction 88 of primary air flow 40 through the terminal unit 20). Thus, the insulation layer 86 may be secured to a downstream-facing side 90 of the panel 84 in an assembled and/or installed configuration of the first baffle 80.

In the illustrated embodiment, the first baffle 80 is disposed within the internal volume 62 and is offset from the inlet panel 26 by a distance 92 (e.g., an offset distance, along the longitudinal axis 48). Further, in the installed configuration, the first baffle 80 may be positioned about the inlet duct 24 such that a downstream face 94 of the first baffle 80 (e.g., a downstream face of the insulation layer 86) is generally aligned with an outlet 96 or opening (e.g., a distal end) of the inlet duct 24. For example, the downstream face 94 of the insulation layer 86 and the outlet 96 of the inlet duct 24 may extend generally within a common plane 98 (e.g., a plane defined by the lateral axis 50 and the vertical axis 52). Thus, the inlet duct 24 may extend into the first baffle 80, but the inlet duct 24 may not extend beyond the first baffle 80 (e.g., in the direction 88, along the longitudinal axis 48, beyond the downstream face 94), in some embodiments. The damper 66 may also be aligned with the downstream face 94 of the insulation layer 86 and the outlet 96 of the inlet duct 24 (e.g., extend within the common plane 98) in a closed position of the damper 66. The first baffle 80 may be secured within the housing 22 in any suitable manner, as described further below.

The baffle system 68 (e.g., the plurality of baffles 70) further includes a second baffle 100 disposed within the internal volume 62 of the housing 22. The second baffle 100 extends crosswise to the first baffle 80 in an installed configuration. In particular, the second baffle 100 of the illustrated embodiment extends from the inlet panel 26 and into the internal volume 62 generally perpendicularly and/or at an approximately ninety-degree angle relative to the first baffle 80 and/or the inlet panel 26 (e.g., within 1, 2, 3, 4, or 5 percent). However, as discussed in further detail below, the second baffle 100 may extend at an oblique angle relative to the first baffle 80 and/or the inlet panel 26, in some embodiments.

The second baffle 100 is disposed between the inlet duct 24 and the side inlet 28 (e.g., relative to the lateral axis 50). The second baffle 100 includes a panel 102 (e.g., structural panel, sheet, second panel, perforated sheet, baffle panel) and two insulation layers 104 (e.g., a first insulation layer 106, a second insulation layer 108). Specifically, the first insulation layer 106 is disposed on a first side 110 (e.g., outward facing side) of the panel 102, and the second insulation layer 108 is disposed on a second side 112 (e.g., inward facing side) of the panel 102. Thus, the first side 110 of the panel 102 and the first insulation layer 106 may generally face the side inlet 28, and the second side 112 of the panel 102 and the second insulation layer 108 may generally face the inlet duct 24. The insulation layers 104 may be formed from any suitable material, such as the materials discussed above regarding the insulation layer 86 of the first baffle 80. In some embodiments, the first and second insulation layers 106 and 108 may be formed from the same material. The insulations layers 104 may be similarly secured or attached to the panel 102, such as via an adhesive or pin welds. In some embodiments, the panel 102 may be a solid panel (e.g., similar to the panel 84 of the first baffle 80, non-perforated panel). In other embodiments, the panel 102 may be a perforated panel (e.g., perforated sheet metal panel, rigid mesh panel). That is, the panel 102 may have a plurality of holes or opens formed therein and arrayed across the panel 102 (e.g., arrayed along the vertical axis 52 and the longitudinal axis 48). In such embodiments, the holes or openings formed in the panel 102 may cumulatively define an "open area" of the panel 102. The open area of the panel 102 defined by the holes, openings, or perforations may be approximately 23 percent or 51 percent (e.g., within 1, 2, 3, 4, or 5 percent, 23 percent perforation, 51 percent perforation) of a total area defined by outer dimensions (e.g., height and width dimensions) of the panel 102, for example. In other embodiments, the open area of the panel 102 may be any other suitable percentage (e.g., between 23 percent and 51 percent, greater than 50 percent) of a total area of the panel 102.

As shown, the second baffle 100 may be coupled to (e.g., secured or attached to) the inlet panel 26. For example, the panel 102 of the second baffle 100 may be secured to the inlet panel 26 via welds, rivets, another mechanical fastener, or any other suitable securement technique. In some embodiments, the panel 102 may include a flange formed (e.g., bent) therein and configured to abut the inlet panel 26, and a mechanical fastener may extend through the flange of the panel 102 and the inlet panel 26 to secure the second baffle 100 to the inlet panel 26. Additionally, the first baffle 80 and the second baffle 100 may be coupled to one another. For example, in the illustrated embodiment, the panel 84 of the first baffle 80 includes a flange 114 configured to abut the panel 102 of the second baffle 100 and enable securement of the first baffle 80 to the second baffle 100. To this end, the second insulation layer 108 of the second baffle 100 may include a notch 116 (e.g., gap, space) formed therein, such that the panel 84 of the first baffle 80 may extend along the lateral axis 50 and within the notch 116, and the flange 114 of the panel 84 may abut the panel 102 of the second baffle 100. The insulation layer 86 of the first baffle 80 may also extend along the lateral axis 50 and within the notch 116. The flange 114 of the panel 84 may be secured to the panel 102 of the second baffle 100 via rivets, welds, brazes, another type of mechanical fastener, or any other suitable securement technique. In other embodiments, the panel 84 may not include the flange 114, and the first baffle 80 (e.g., a lateral end of the first baffle 80) may be captured or otherwise disposed within the notch 116 formed in the second insulation layer 108 (e.g., via an interference fit) to retain the first baffle 80 in a desired position.

In the installed configuration within the housing 22, the second baffle 100 of the illustrated embodiment extends from the inlet panel 26 and along the longitudinal axis 48. In particular, the second baffle 100 extends along the longitudinal axis 48 beyond the side inlet 28 (e.g., in the direction 88). Thus, the second baffle 100 overlaps (e.g., fully or substantially overlaps) the side inlet 28 (e.g., relative to the lateral axis 50). In other words, an entirety of the side inlet 28 is aligned with the second baffle 100 along the lateral axis 50. As will be appreciated, the second baffle 100 (e.g., the construction of the second baffle 100 and/or the arrangement of the second baffle 100 within the housing 22) may block or reduce transmission of sound from the housing 22 via the side inlet 28. For example, the panel 102 (e.g., perforated panel, rigid mesh panel), the insulation layers 104, or any combination thereof may absorb or otherwise attenuate sound (e.g., acoustic waves) generated within the housing 22 (e.g., within the internal volume 62), such that transmission of sound out of the housing 22 via the side inlet 28 (e.g., proximate the second baffle 100) is reduced. The position of the second baffle 100 relative to the side inlet 28 (e.g., relative to the side panel 30, 60 of the housing 22) may also be selected to enable desirable air flow (e.g., induced air flow 42) into the housing 22. For example, an offset distance 118 (e.g., extending along lateral axis 50) between the side panel 30, 60 defining the side inlet 28 and the first insulation layer 106 may be selected to enable desirable flow (e.g., target flow rate) of induced air flow 42 into the housing 22 while also achieving a desired reduction in sound output by the terminal unit 20 via the side inlet 28.

The baffle system 68 (e.g., the plurality of baffles 70) also includes a third baffle 140 (e.g., baffle panel, sheet) extending from the inlet panel 26 and extending into the internal volume 62 along the longitudinal axis 48. The third baffle 140 is disposed opposite the second baffle 100 relative to the inlet duct 24. Thus, the third baffle 140 extends between the inlet duct 24 and a side panel 142 (e.g., panel 60) of the housing 22, whereby the side panel 142 is opposite a side panel 144 (e.g., panel 30, 60) defining the side inlet 28 relative to the internal volume 62. The third baffle 140, the second baffle 100, the side panel 142, and/or the side panel 144 may extend approximately parallel with one another (e.g., parallel to the longitudinal axis 48, within 1, 2, 3, 4, or 5 percent of parallel). In the illustrated embodiment, the third baffle 140 is offset from the side panel 142 by a distance 146 (e.g., offset distance, extending along the lateral axis 50). The distance 146 may be selected to enable desired attenuation of sound within the housing 22 via the third baffle 140. For example, the distance 146 may be approximately (e.g., within 1, 2, 3, 4, or 5 percent) one inch, in some embodiments.

The third baffle 140 may be a perforated sheet or panel (e.g., perforated sheet metal panel, rigid mesh panel). For example, holes or openings may be formed in the third baffle 140 (e.g., panel, sheet) and may cumulatively define an "open area" of the third baffle 140. The open area of the third baffle 140 defined by the holes, openings, or perforations may be approximately 23 percent or 51 percent (e.g., within 1, 2, 3, 4, or 5 percent) of a total area defined by outer dimensions (e.g., height and width dimensions) of the third baffle 140, for example. In other embodiments, the open area of the third baffle 140 may be any other suitable percentage of a total area of the third baffle 140 (e.g., greater than half). The third baffle 140 may not include an insulation layer in some embodiments. Therefore, the third baffle 140 may be configured to enable flow of air (e.g., primary air flow 40) therethrough. As similarly discussed above, the third baffle 140 (e.g., perforated panel) may be secured to the inlet panel 26 via welds, rivets, another mechanical fastener, or any other suitable securement technique. In some embodiments, the third baffle 140 may include a flange formed (e.g., bent) therein and configured to abut the inlet panel 26, and a mechanical fastener may extend through the flange of the third baffle 140 and the inlet panel 26 to secure the third baffle 140 to the inlet panel 26.

The baffle system 68 (e.g., the plurality of baffles 70) further includes a fourth baffle 150 (e.g., baffle panel, sheet) and a fifth baffle 152 (e.g., baffle panel, plate). The fourth baffle 150 and the fifth baffle 152 each extend between the second baffle 100 and the third baffle 140. That is, the fourth baffle 150 and the fifth baffle 152 each extend from the second baffle 100 to the third baffle 140. To this end, the fourth baffle 150 and the fifth baffle 152 may each be coupled to (e.g., secured or attached to) the second baffle 100 and the third baffle 140. Thus, the fourth baffle 150 and the fifth baffle 152 may also be offset from the side panel 142 of the housing 22 by the distance 146 (e.g., approximately one inch). In some embodiments, the fourth baffle 150 may include one or more flanges 154 formed at ends (e.g., lateral ends) of the fourth baffle 150. The flanges 154 may be bent or otherwise defined by the fourth baffle 150, and each flange 154 may abut against the second baffle 100 or the third baffle 140 to enable securement of the fourth baffle 150 to the second baffle 100 and the third baffle 140 (e.g., via mechanical fasteners, such as rivets). Similarly, the fifth baffle 152 may include one or more flanges 156 that are formed (e.g., via bending) in the fifth baffle 152 and are configured to abut one of the second baffle 100 and the third baffle 140 to enable mechanical securement thereto.

As shown, the fourth baffle 150 and the fifth baffle 152 may each extend generally parallel to the first baffle 80 and/or the inlet panel 26 (e.g., along the lateral axis 50). In the illustrated embodiment, the fourth baffle 150 is offset from the inlet panel 26 by a distance 158 (e.g., an offset distance) along the longitudinal axis 48 and in the direction 88. A magnitude of the distance 158 may be selected to position the fourth baffle 150 within the internal volume 62 (e.g., relative to the inlet duct 24 and/or outlet 96) in a configuration that enables desirable attenuating of sound or noise generated within the housing 22. For example, in some embodiments, the distance 158 may be equal to approximately (e.g., within 1, 2, 3, 4, or 5 percent) 12 inches, 14 inches, or another suitable distance. The fifth baffle 152 is offset from the fourth baffle 150 by a distance 160 (e.g., offset distance) along the longitudinal axis 48 and in the direction 88. A magnitude of the distance 160 may similarly be selected to position the fifth baffle 152 within the internal volume 62 (e.g., relative to the inlet duct 24 and/or outlet 96, relative to the fourth baffle 150) in a configuration that enables desirable attenuating of sound or noise generated within the housing 22. For example, the distance 160 may be equal to approximately (e.g., within 1, 2, 3, 4, or 5 percent) one inch, two inches, or another suitable distance.

Further, the fourth baffle 150 and the fifth baffle 152 may each be formed as a perforated panel or sheet and/or may not include insulation layers. For example, the fourth baffle 150 and the fifth baffle 152 may each be formed from perforated sheet metal. As similarly described above, the fourth baffle 150 and the fifth baffle 152 may each have a plurality of holes or openings formed therein and arrayed across the respective baffle 150, 152 (e.g., arrayed along the lateral axis 50 and the vertical axis 52). In such embodiments, the holes or openings formed in the respective baffle 150, 152 may cumulatively define an "open area" of the respective baffle 150, 152. The open area of each baffle 150, 152 defined by the holes, openings, or perforations thereof may be approximately 23 percent or 51 percent (e.g., within 1, 2, 3, 4, or 5 percent) of a total area defined by outer dimensions (e.g., height and width dimensions) of the respective baffle 150, 152, for example. In other embodiments, the respective open areas of the baffles 150, 152 may be any other suitable percentage of a total area of the baffles 150, 152 (e.g., greater than half) that enables desirable flow of air thereacross and attenuation of sound generated within the housing 22

The fourth baffle 150 (e.g., perforated panel) and the fifth baffle 152 (e.g., perforated panel) are each disposed downstream of the first baffle 80 and the outlet 96 of the inlet duct 24 (e.g., relative to the direction 88 of primary air flow 40 through the terminal unit 20). Accordingly, as shown in the illustrated embodiment, the first baffle 80, the second baffle 100, the third baffle 140, and the fourth baffle 150 generally define a volume 162 (e.g., space, region) that receives the primary air flow 40 (e.g., via the inlet duct 24) during operation of the terminal unit 20. Similarly, the second baffle 100, the third baffle 140, the fourth baffle 150, and the fifth baffle 152 generally define a volume 164 (e.g., space, region) that may receive primary air flow 40 (e.g., via the volume 162) during operation of the terminal unit 20. As the third baffle 140, fourth baffle 150, and fifth baffle 152 may be formed as perforated panels (e.g., porous sheets), the third baffle 140, fourth baffle 150, and fifth baffle 152 may enable air flow therethrough while also enabling sound attenuation within the housing 22. For example, acoustic waves generated during operation of the terminal unit 20 may be trapped or at least partially contained within the volumes 162, 164, thereby blocking transmission of the acoustic waves out of the housing 22 and reducing sound transmission from the terminal unit 20.

Figure 6:
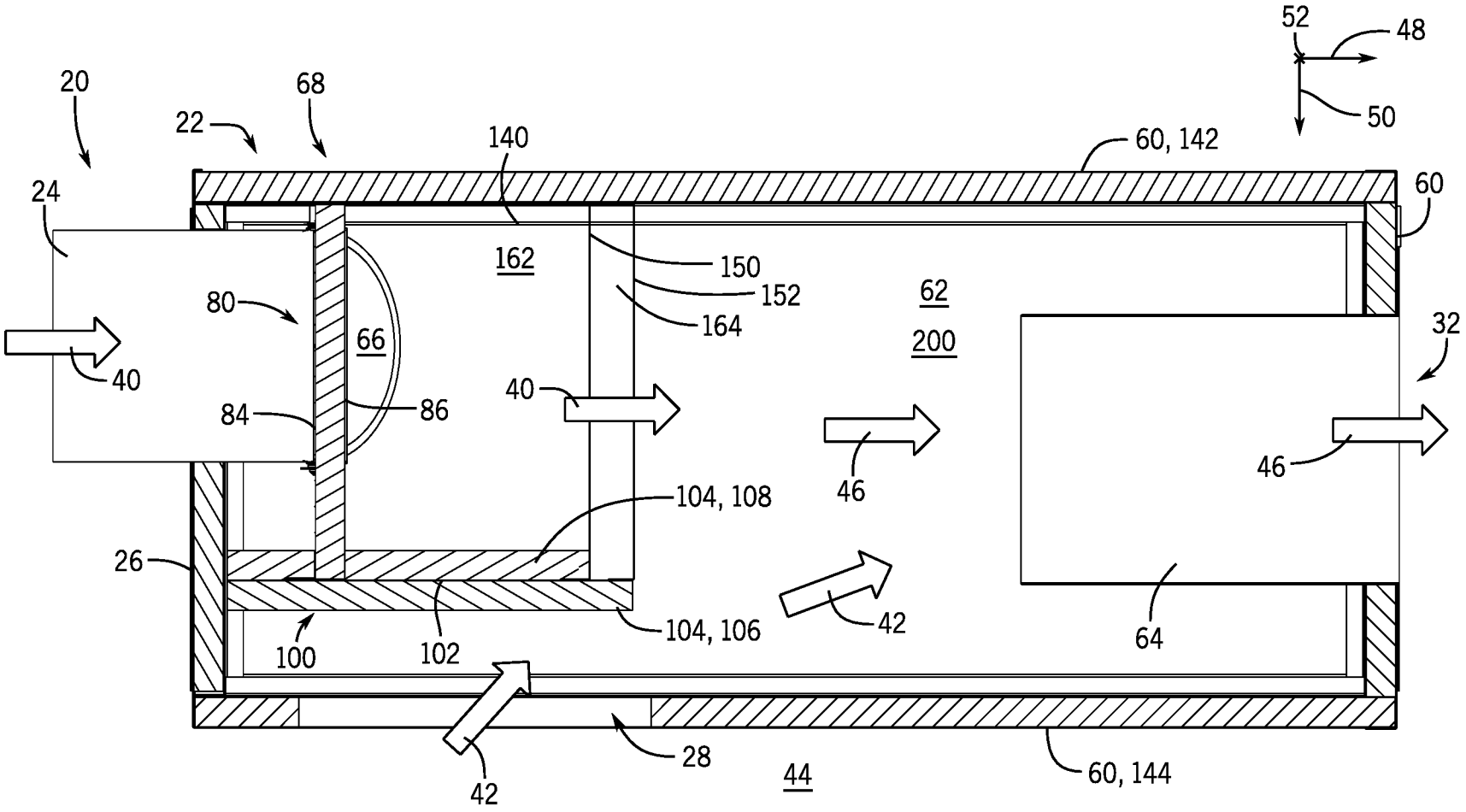
FIG. 6 is a schematic top view of an embodiment of a terminal unit, illustrating a baffle system and air flow through the terminal unit, in accordance with an aspect of the present disclosure.

FIG. 6 is a top view schematic of an embodiment of the terminal unit 20, illustrating an embodiment of the baffle system 68 disposed within the internal volume 62 of the housing 22 and air flow traveling through the terminal unit 20. The illustrated embodiment of FIG. 6 is similar to the embodiment illustrated in FIG. 5 and includes similar elements and element numbers. For example, the second baffle 100 extends from the inlet panel 26, is generally parallel to the third baffle 140, and is generally perpendicular to the first baffle 80, the fourth baffle 150, and the fifth baffle 152.

As discussed above, the terminal unit 20 is configured to receive the primary air flow 40 via the inlet duct 24, such as via operation of the blower 64 disposed within the housing 22. That is, the inlet duct 24 is configured to direct the primary air flow 40 into the internal volume 62 of the housing 22. More particularly, the primary air flow 40 discharged via the outlet 96 of the inlet duct 24 is initially received by the volume 162 defined by the first baffle 80, second baffle 100, third baffle 140, and fourth baffle 150 described above. As the third baffle 140 and fourth baffle 150 may be formed as perforated panels or sheets (e.g., perforated sheet metal, without insulation layers), the third baffle 140 and/or the fourth baffle 150 may enable flow of the primary air flow 40 thereacross. The perforated panels of the third baffle 140 and/or the fourth baffle 150 may enable capture and/or attenuation of sound or noise generated during operation of the terminal unit 20 (e.g., generated via flow of the primary air flow 40 into the housing 22). Additionally, the first baffle 80 and the second baffle 100 may further attenuate sound or noise generated within the housing 22. For example, the insulation layer 86 of the first baffle 80, the insulation layers 104 of the second baffle 100, and/or the panel 102 (e.g., perforated sheet) of the second baffle 100 may further attenuate and/or absorb sound (e.g., acoustic waves) generated within the housing 22 (e.g., generated via the primary air flow 40) as the primary air flow 40 is directed therethrough. Similarly, the primary air flow 40 may travel from the volume 162, across the fourth baffle 150 (e.g., perforated panel), and into the volume 164 generally defined by the second baffle 100, third baffle 140, fourth baffle 150, and fifth baffle 152. The primary air flow 40 may flow from the volume 164, across the fifth baffle 152 (e.g., perforated panel) and into a main volume 200 of the housing 22, and the fourth baffle 150 and fifth baffle 152 may at least partially capture or attenuate sound within the volume 164. In this way, the baffle system 68 may reduce discharge or emission of sound from the terminal unit 20 (e.g., from the internal volume 62 of the housing 22).

The terminal unit 20 is also configured to receive the induced air flow 42 (e.g., return air flow) into the internal volume 62 via the side inlet 28. For example, operation of the blower 64 may draw the induced air flow 42 into the housing 22 via the side inlet 28. In some embodiments, the second baffle 100 (e.g., the panel 102, one or both of the insulation layers 104) may reduce generation of noise that may otherwise be caused by flow of the induced air flow 42 into the housing 22. Additionally or alternatively, the second baffle 100 may reduce transmission of noise (e.g., generated via operation of the blower 64) from the internal volume 62 to the exterior environment 44 via the side inlet 28 (e.g., in a direction opposite the direction of the induced air flow 42).

As shown in the illustrated embodiment, the induced air flow 42 may flow into the housing 22 via the side inlet 28 at least partially along the lateral axis 50 and may travel toward the main volume 200 (e.g., mixing region) of the housing 22. The primary air flow 40 and the induced air flow 42 may combine or mix with one another in the main volume 200 to produce the supply air flow 46, and the supply air flow 46 may be discharged (e.g., via operation of the blower 64) from the housing 22 through the outlet 32.

Figure 7:
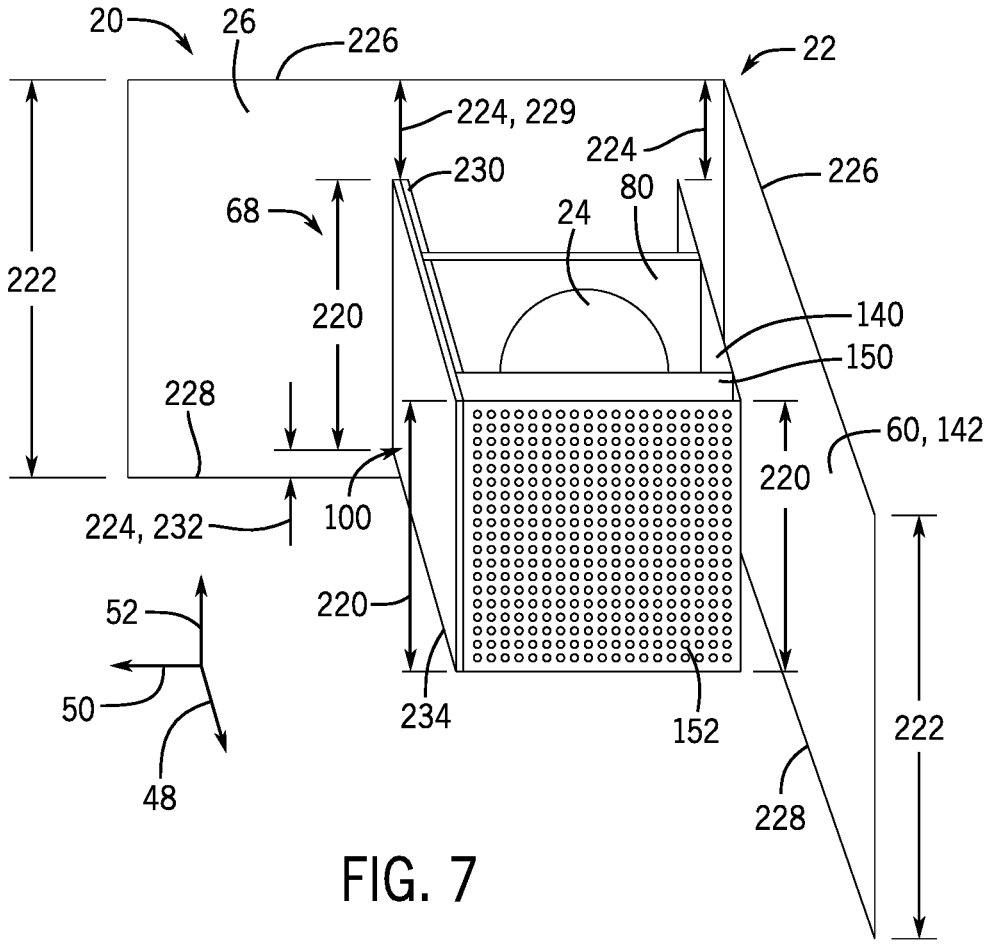
FIG. 7 is a schematic perspective view of an embodiment of a baffle system of a terminal unit, in accordance with an aspect of the present disclosure.

FIG. 7 is a perspective view schematic of a portion of an embodiment of the terminal unit 20, illustrating an embodiment of the baffle system 68 in an assembled configuration. The illustrated embodiment of FIG. 7 is similar to the embodiment illustrated in FIG. 5 and includes similar elements and element numbers. For example, the second baffle 100 extends from the inlet panel 26, is generally parallel to the third baffle 140, and is generally perpendicular to the first baffle 80, the fourth baffle 150, and the fifth baffle 152. Various elements of the terminal unit 20 are omitted from the illustrated embodiment to better illustrate the arrangement of the baffle system 68 within the internal volume 62 of the housing 22.

As discussed above, the baffle system 68 includes the plurality of baffles 70 disposed within the internal volume 62 of the housing 22, which is defined by the plurality of panels 60 (e.g., inlet panel 26, side panel 30, side panel 142, outlet panel 34). Additionally, one or more of the baffles 70 may extend along the longitudinal axis 48 (e.g., the second baffle 100, the third baffle 140) or the lateral axis 50 (e.g., the first baffle 80, the fourth baffle 150, the fifth baffle 152). In the illustrated embodiment, each baffle 70 of the baffle system 68 also extends along the vertical axis 52. That is, each baffle 70 extends for a respective height 220 (e.g., dimension, vertical dimension) of the corresponding baffle 70, and the height 220 of each baffle 70 extends generally along the vertical axis 52. Similarly, the panels 60 of the housing 22 also extend along the vertical axis 52 by respective heights 222 (e.g., dimensions, vertical dimensions). In some embodiments, the height 220 of one or more baffles 70 may be approximately equal to the heights 222 of the panels 60. In other words, the baffles 70 may extend within the internal volume 62 from a top panel to a bottom panel of the housing 22 (e.g., a full height of the internal volume 62 along the vertical axis 52). However, in other embodiments such as the illustrated embodiment, the respective height 220 of one or more baffles 70 of the baffle system 68 may be less than the heights 222 of panels 60 that define the housing 22. Accordingly, a gap or space 224 may extend between one or more of the baffles 70 and an upper or lower panel (e.g., panel 60) of the housing 22.

In the illustrated embodiment, respective upper edges 226 (e.g., relative to vertical axis 52, first edges) of the inlet panel 26 and the side panel 142 may be indicative of a location of a top panel of the housing 22, which is omitted for clarity. Similarly, respective lower edges 228 (e.g., relative to vertical axis 52, second edges) of the inlet panel 26 and the side panel 142 may be indicative of a location of a bottom or base panel of the housing 22, which is also omitted for clarity. For example, a first gap or space 229 (e.g., offset distance) extends between an upper edge 230 (e.g., relative to the vertical axis 52) of the second baffle 100 and the upper edge 226 of the inlet panel 26. In other words, the second baffle 100 may be offset from the top panel (e.g., panel 60) of the housing 22 by a magnitude or dimension of the first gap 229. Similarly, a second gap or space 232 (e.g., offset distance) extends between a lower edge 234 (e.g., relative to the vertical axis 52) of the second baffle 100 and the lower edge 228 of the inlet panel 26. In other words, the second baffle 100 may be offset from the bottom panel (e.g., panel 60) of the housing 22 by a magnitude or dimension of the second gap 232. In other embodiments, the second baffle 100 may abut one of the bottom panel or top panel of the housing 22 and may be offset from the other of the bottom panel or top panel. It should be appreciated that any of the baffles 70 of the baffle system 68 may be offset from one or both of the top panel and bottom panel of the housing 22 (e.g., to define one or more corresponding gaps 224), such that the respective height 220 of the corresponding baffle 70 is less than the height 222 of the panels 60.

In some instances, it may be desirable to arrange one or more baffles 70 within the internal volume 62 to be offset (e.g., along vertical axis 52) from the top panel and/or bottom panel of the housing 22. For example, by positioning one or more of the baffles 70 at an offset distance from a top panel or bottom panel of the housing 22, one or more gaps 224 described above may be defined. The gaps 224 extending between the baffles 70 and the housing 22 (e.g., top panel, bottom panel) may reduce restriction of air flow (e.g., primary air flow 40, induced air flow 42) through the terminal unit 20. However, in some embodiments to may be desirable to include baffles 70 with heights 220 that are substantially equal to heights 222 of one or more panels 60 (e.g., side panels, inlet panel 26, side panel 144, side panel 142) to enable increased attenuation of sound (e.g., via the baffles 70) generated within the housing 22. Indeed, certain baffles 70 of the baffle system 68 may be configured and arranged to define corresponding gaps 224, while other baffles 70 may be incorporated to have heights 220 that are substantially equal to heights 222 of one or more panels 60 defining lateral sides of the housing 22. Alternatively, all baffles 70 in an embodiment of the baffle system 68 may have respective heights 220 that are substantially equal to the heights 222 of the panels 60 (e.g., side panels) or are less than the heights 222 of the panels 60 (e.g., side panels).

Figure 8:
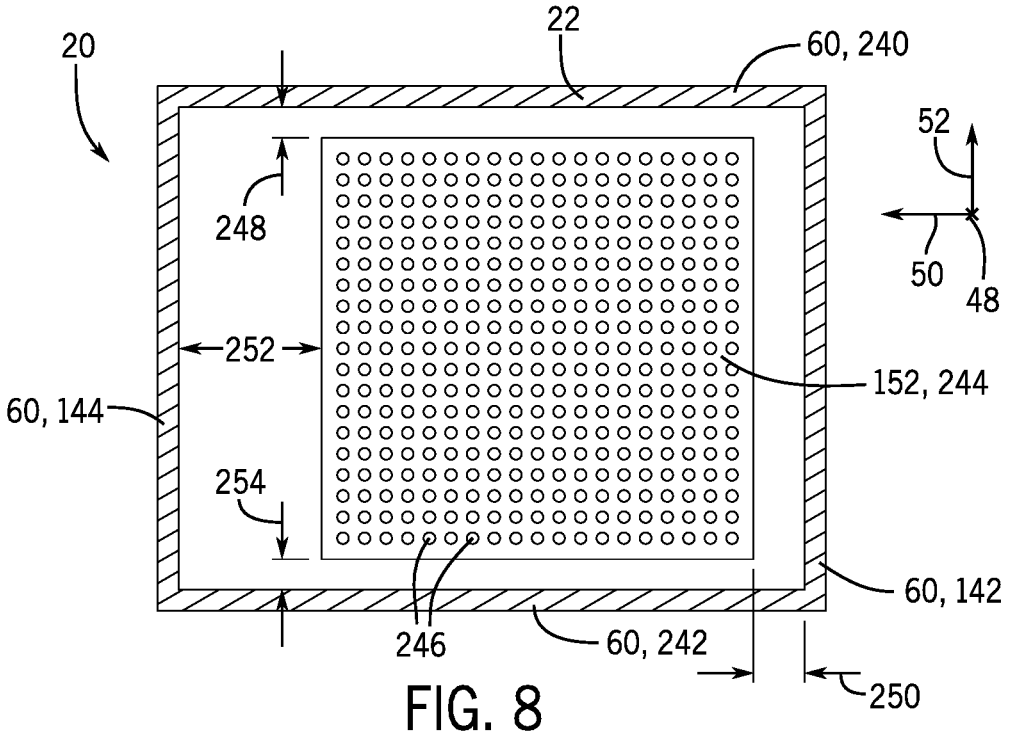
FIG. 8 is a schematic side section schematic of an embodiment of a terminal unit having a baffle system, in accordance with an aspect of the present disclosure.

FIG. 8 is an axial view schematic of an embodiment of the terminal unit 20, illustrating a relative location of the baffle system 68 within the internal volume 62 with respect to panels 60 of the housing 22. As discussed above, the panels 60 include the side panels 142 and 144 (e.g., lateral side panels). The panels 60 defining the housing 22 also include a top or upper panel 240 and a bottom or base panel 242. In the illustrated embodiment, the fifth panel 152 is illustrated a perforated panel 244 including perforations 246. The perforated panel 244 may be incorporated as any of the perforated panels described above. The fifth panel 152 is offset from the top panel 240 by a distance 248 (e.g., to define a gap therebetween, along vertical axis 52). Similarly, the fifth panel 152 is offset from the side panel 142 by a distance 250 (e.g., along lateral axis 50), is offset from the side panel 144 by a distance 252 (e.g., along lateral axis 50), and is offset from the bottom panel 242 by a distance 254 (e.g., along vertical axis 52) to define corresponding gaps therebetween. Respective magnitudes of the distances 248, 250, 252, and 254 may be selected to enable desirable positioning of the fifth panel 152 within the internal volume 62, enable desirable air flow through the housing 22, enable desirable attenuation of sound or noise generated by the terminal unit 20, or any combination thereof. It should be appreciated that corresponding positions of other baffles 70 of the baffle system 68 (e.g., relative to panels 60 of the housing 22) may be similarly selected to achieve the benefits described herein.

Figure 9:
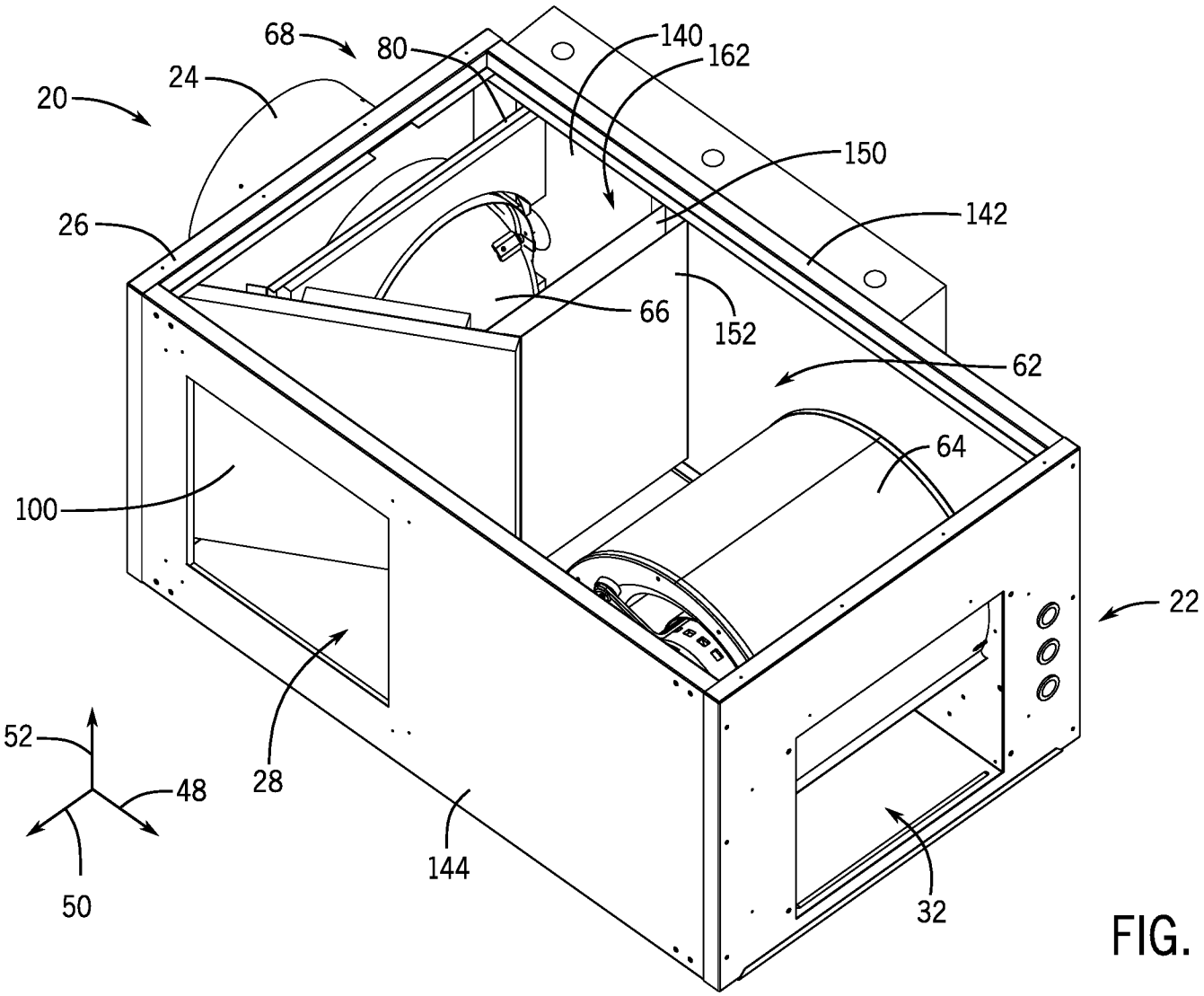
FIG. 9 is a perspective view of an embodiment of a terminal unit, illustrating a baffle system of the terminal unit, in accordance with an aspect of the present disclosure.

FIG. 9 is a perspective view of an embodiment of the terminal unit 20, illustrating another configuration of the baffle system 68 within the internal volume 62 of the housing 22. The illustrated embodiment of FIG. 9 includes similar elements and element numbers as the embodiment illustrated and described above with reference to FIGS. 4 and 5 and may be configured to operate in a similar manner. For example, the baffle system 68 includes the first baffle 80, the second baffle 100, the third baffle 140, the fourth baffle 150, and the fifth baffle 152. However, in the illustrated embodiment, the second baffle 100 is disposed at an oblique angle (e.g., an acute angle) relative to the inlet panel 26, the first baffle 80, the fourth baffle 150, and the fifth baffle 152. The configuration of the baffle system 68, including the second baffle 100 disposed at an oblique angle, is described in further detail below.

Figure 10:
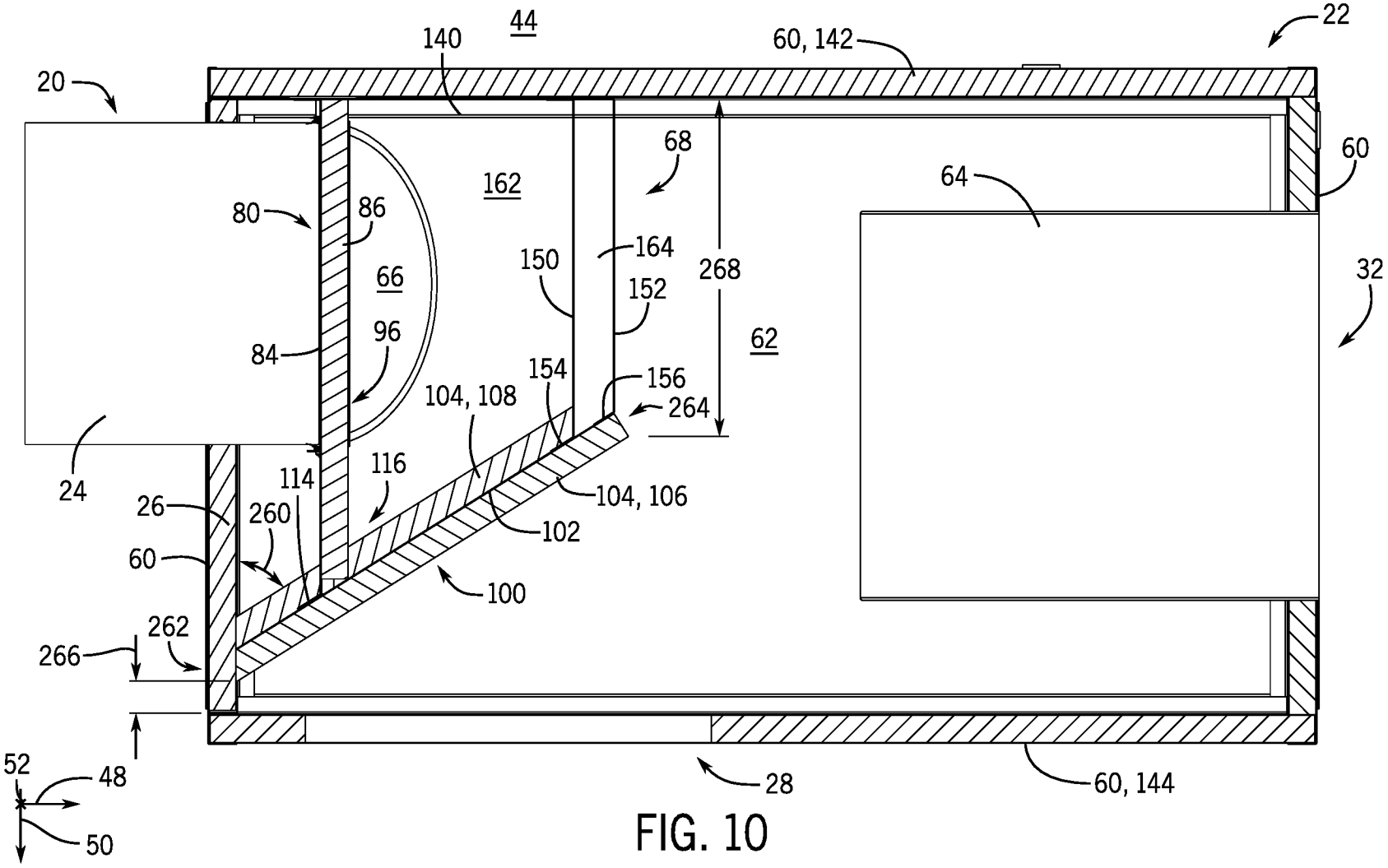
FIG. 10 is a schematic top view of an embodiment of a terminal unit, illustrating a baffle system of the terminal unit, in accordance with an aspect of the present disclosure.

FIG. 10 is a top view schematic of an embodiment of the terminal unit 20, illustrating an embodiment of the baffle system 68 disposed within the internal volume 62 of the housing 22. The illustrated embodiment of FIG. 10 includes similar elements and element numbers as the embodiment illustrated and described above with reference to FIG. 5. As similarly described above, the baffle system 68 includes the first baffle 80, the second baffle 100, the third baffle 140, the fourth baffle 150, and the fifth baffle 152, which may have features and/or configurations similar to those described above. For example, the first baffle 80 of the illustrated embodiment may have a similar construction and/or configuration as the first baffle 80 discussed above (e.g., panel 84, insulation layer 86), the second baffle 100 of the illustrated embodiment may have a similar construction and/or configuration as the second baffle 100 discussed above (e.g., panel 102, first and second insulation layers 106, 108), the third baffle 140 of the illustrated embodiment may have a similar construction and/or configuration as the third baffle 140 discussed above, and so forth. The first baffle 80, the third baffle 140, the fourth baffle 150, and/or the fifth baffle 152 may also be arranged within the housing 22 and/or as components of the baffle system 68 (e.g., relative to one another) in a manner similar to that described above. For example, the first baffle 80 may be disposed about the inlet duct 24 as similarly described above, the third baffle 140 may extend from the inlet panel 26 and may be disposed adjacent the side panel 142 of the housing 22 (e.g., at the offset distance 146), the fourth baffle 150 may be disposed downstream of the first baffle 80 (e.g., relative to the direction 88 along the longitudinal axis 48) and may be generally parallel with the first baffle 80, and the fifth baffle 152 may be disposed downstream of the fourth baffle 150 (e.g., relative to the direction 88 along the longitudinal axis 48) and may be generally parallel with the first baffle 80 and the fourth baffle 150.

In the illustrated embodiment, the second baffle 100 is disposed at an oblique angle 260 (e.g., less than 90 degrees) relative to the inlet panel 26. That is, the second baffle 100 is coupled to the inlet panel 26 and extends from the inlet panel 26 at the oblique angle 260. Thus, the second baffle 100 also extends at the oblique angle 260 relative to the first baffle 80. The oblique angle 260 may have any suitable value or magnitude, such as 30 degrees, 35 degrees, 40 degrees, 45 degrees, 50 degrees, 55 degrees, 60 degrees, 65 degrees, 70 degrees, or another suitable value. In the illustrated (e.g., angled) arrangement, the second baffle 100 includes a base end 262 (e.g., first end) coupled to (e.g., secured to) the inlet panel 26 and a distal end 264 (e.g., second end) opposite the base end 262. The base end 262 may be coupled to the inlet panel 26 utilizing any suitable technique, including but not limited to those described above (e.g., a flange formed in the panel 102 and abutting the inlet panel 26, rivets, welds, adhesives, other mechanical fasteners, and so forth).

The second baffle 100 may include the panel 102, the first insulating layer 106 disposed on the first side 110 of the panel 102, and the second insulating layer 108 disposed on the second side 112 of the panel 102. In some embodiments, the panel 102 (e.g., the second baffle 100) may be secured to the inlet panel 26 as similarly described above. For example, the panel 102 may include a flange formed at the base end 262 of the panel 102, the flange may abut the inlet panel 26, and a mechanical fastener extending through the flange (e.g., the panel 102) and the inlet panel 26 to couple the second baffle 100 to the inlet panel 26. In other embodiments, the second baffle 100 may be coupled to the inlet panel 26 via another suitable technique (e.g., welds, brazes, adhesives). The first baffle 80 may also be coupled to the second baffle 100 in a manner similar to that described above. For example, the notch 116 may be formed in the second insulating layer 108 of the second baffle 100, and the first baffle 80 may extend at least partially into the notch 116. In some embodiments, the panel 84 of the first baffle 80 may include the flange 114 (e.g., extending obliquely relative to a reminder of the panel 84) configured to abut the panel 102 of the second baffle 100 and be secured to the panel 102 via a mechanical fastener extending therethrough. The insulating layer 86 of the first baffle 80 may also extend at least partially into the notch 116 formed in the second insulating layer 108 of the second baffle 100. Thus, the first baffle 80 may be at least partially captured or otherwise disposed between sections, segments, or portions of the second insulating layer 108. In other embodiments, the panel 84 of the first baffle 80 may not include the flange 114, and the first baffle 80 may be coupled to the second baffle 100 via an interference fit (e.g., formed via frictional engagement between the second insulating layer 108, the panel 84, and the insulating layer 86) or via another suitable securement technique.

The second baffle 100 disposed at the oblique angle 260 may also be configured to couple to the fourth baffle 150 and the fifth baffle 152, such as in a manner similar to that described above. For example, as shown in the illustrated embodiment, the fourth panel 150 may include the flange 154 disposed at an end of the fourth baffle 150 adjacent the second baffle 100 (e.g., in an installed configuration), and the flange 154 may abut and/or be secured to the panel 102 of the second baffle 100 (e.g., via a mechanical fastener, such as a rivet). Similarly, the fifth panel 152 may include the flange 156 disposed at an end of the fifth baffle 152 adjacent the second baffle 100 (e.g., in an installed configuration), and the flange 156 may abut and/or be secured to the panel 102 of the second baffle 100 (e.g., via a mechanical fastener, such as a rivet). In some embodiments, the flange 154 of the fourth baffle 150 may be at least partially captured between the second insulation layer 108 and the panel 102 of the second baffle 100 in an installed configuration. The flange 156 of the fifth baffle 152 may similarly be at least partially captured between the flange 154 of the fourth baffle 150 and the panel 102 of the second baffle 100 in an installed configuration.

The second baffle 100 extending at the oblique angle 260 may be disposed within the housing 22 at any suitable position relative to the panels 60 defining the housing 22. In some embodiments, the base end 262 may be secured to the inlet panel 26 at an offset distance 266 (e.g., dimension) from the side panel 144 of the housing 22. The offset distance 266 may have any suitable magnitude, such as approximately 1.5 inches, 2 inches, or 2.5 inches. Similar to embodiments described above, the illustrated embodiment of the second baffle 100 at the oblique angle 260 extends at least partially along the longitudinal axis 48 beyond the side inlet 28 (e.g., in the direction 88). Thus, the second baffle 100 overlaps (e.g., fully or substantially overlaps) the side inlet 28 (e.g., relative to the lateral axis 50), which may enable the second baffle 100 to block or reduce transmission of sound from the housing 22 via the side inlet 28. Additionally, in the illustrated embodiment, the distal end 264 of the second baffle 100 is disposed at an offset distance 268 (e.g., dimension) from the side panel 142 of the housing 22 (e.g., opposite the side panel 144 defining the side inlet 28). The offset distance 268 may have any suitable magnitude, such as approximately 15 inches, approximately 16 inches, or approximately 17 inches.

In the illustrated configuration of the second baffle 100 (e.g., at the oblique angle 260), the second baffle 100 may be configured to attenuate or reduce noise output by the terminal unit 20, whereby the noise may be generated via multiple sources or operations of the terminal unit 20. For example, the first insulating layer 106 may be configured to reduce transmission of noise or sound out of the terminal unit 20 (e.g., via the side inlet 28) that is generated via operation of the blower 64. The second insulating layer 108 may be configured to reduce transmission of noise or sound out of the terminal unit 20 (e.g., via the side inlet 28) that is generated via operation of the damper 66 and/or via flow of the primary air flow 40 into the housing 22 via the inlet duct 24.

In some applications, the configuration of the second baffle 100 at the oblique angle 260 may enable an increased size (e.g., volume) of the volume 162 (e.g., region, space) and/or the volume 164 (e.g., region, space), which may enable improved attenuation or reduction of sound output by the terminal unit 20. For example, the increased size of the volume 162 and/or volume 164 may enable capture of a wider range (e.g., frequency) of acoustic waves in some applications. In some embodiments, the increased size of the volume 162 and/or volume 164 may enable improved sound output reduction in embodiments of the terminal unit 20 that are configured to provide increased air flows (e.g., greater amounts of primary air flow 40 and/or induced air flow 42) through the terminal unit 20.

Figure 11:
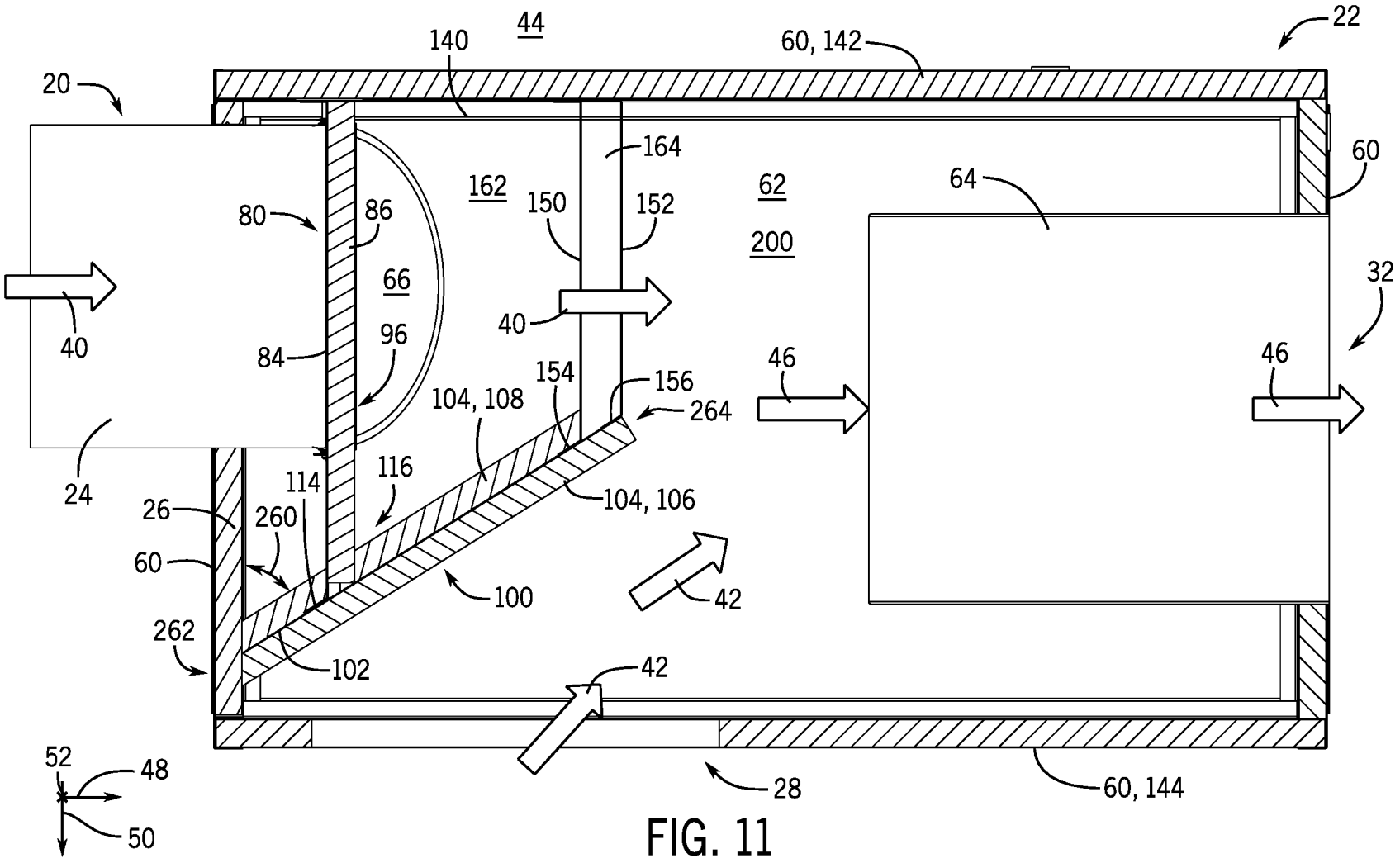
FIG. 11 is a schematic top view of an embodiment of a terminal unit, illustrating a baffle system and air flow through the terminal unit, in accordance with an aspect of the present disclosure.

FIG. 11 is a top view schematic of an embodiment of the terminal unit 20, illustrating an embodiment of the baffle system 68, including the second baffle 100 disposed at the oblique angle 260, disposed within the housing 22. The embodiment of FIG. 11 also illustrates air flow (e.g., primary air flow 40 and induced air flow 42) directed through the terminal unit 20. The illustrated embodiment of FIG. 11 is similar to the embodiment illustrated in FIG. 10 and includes similar elements and element numbers.

As discussed above, the terminal unit 20 is configured to receive the primary air flow 40 via the inlet duct 24, such as via operation of the blower 64 disposed within the housing 22. More particularly, the primary air flow 40 discharged via the outlet 96 of the inlet duct 24 is initially received by the volume 162 defined by the first baffle 80, second baffle 100, third baffle 140, and fourth baffle 150 described above. A size of the volume 162 may be increased by virtue of the second baffle 100 disposed at the oblique angle 260. As the third baffle 140 and fourth baffle 150 may be formed as perforated panels or sheets (e.g., perforated sheet metal, without insulation layers), the third baffle 140 and/or the fourth baffle 150 may enable flow of the primary air flow 40 thereacross. The perforated panels of the third baffle 140 and/or the fourth baffle 150 may enable capture and/or attenuation of sound or noise generated during operation of the terminal unit 20 (e.g., generated via flow of the primary air flow 40 into the housing 22). Additionally, the first baffle 80 and the second baffle 100 may further attenuate sound or noise generated within the housing 22. For example, the insulation layer 86 of the first baffle 80, the insulation layers 104 of the second baffle 100, and/or the panel 102 (e.g., perforated sheet) of the second baffle 100 may further attenuate and/or absorb sound (e.g., acoustic waves) generated within the housing 22 (e.g., generated via the primary air flow 40) as the primary air flow 40 is directed therethrough. Similarly, the primary air flow 40 may travel from the volume 162, across the fourth baffle 150 (e.g., perforated panel), and into the volume 164 generally defined by the second baffle 100, third baffle 140, fourth baffle 150, and fifth baffle 152. The primary air flow 40 may flow from the volume 164, across the fifth baffle 152 (e.g., perforated panel) and into the main volume 200 (e.g., mixing section) of the housing 22, and the fourth baffle 150 and fifth baffle 152 may at least partially capture or attenuate sound (e.g., acoustic waves) within the volume 164. In this way, the baffle system 68 may reduce discharge or emission of sound from the terminal unit 20 (e.g., from the internal volume 62 of the housing 22).

The terminal unit 20 is also configured to receive the induced air flow 42 (e.g., return air flow) into the internal volume 62 via the side inlet 28. For example, operation of the blower 64 may draw the induced air flow 42 into the housing 22 via the side inlet 28. In some embodiments, the second baffle 100 (e.g., the panel 102, one or both of the insulation layers 104) may reduce generation of noise that may otherwise be caused by flow of the induced air flow 42 into the housing 22. Additionally or alternatively, the second baffle 100 may reduce transmission of noise (e.g., generated via operation of the blower 64) from the internal volume 62 to the exterior environment 44 via the side inlet 28 (e.g., in a direction opposite the direction of the induced air flow 42).

As shown in the illustrated embodiment, the induced air flow 42 may flow into the housing 22 via the side inlet 28 at least partially along the lateral axis 50 and may travel toward the main volume 200 of the housing 22. The primary air flow 40 and the induced air flow 42 may combine or mix with one another in the main volume 200 to produce the supply air flow 46, and the supply air flow 46 may be discharged (e.g., via operation of the blower 64) from the housing 22 through the outlet 32.

Figure 12:
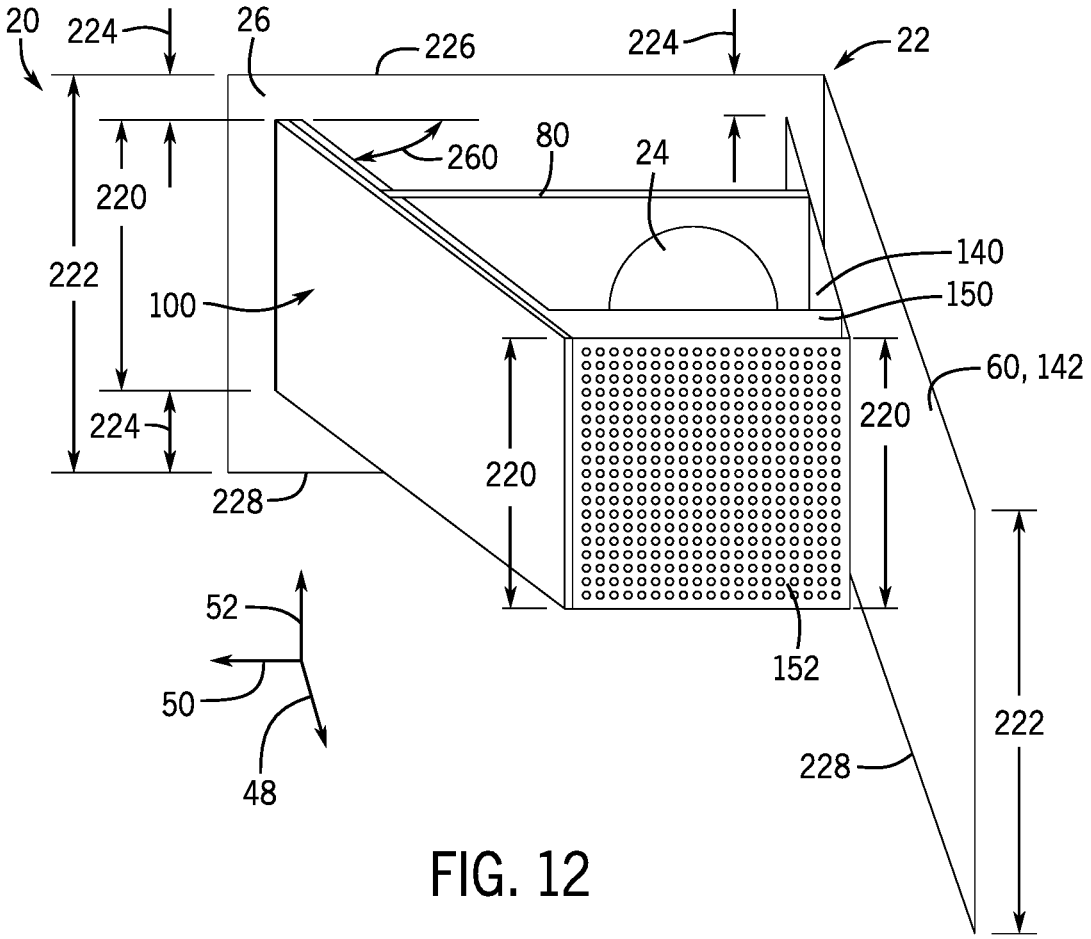
FIG. 12 is a schematic perspective view of an embodiment of a baffle system of a terminal unit, in accordance with an aspect of the present disclosure.

FIG. 12 is a perspective view schematic of a portion of an embodiment of the terminal unit 20, illustrating an embodiment of the baffle system 68, including the second baffle 100 disposed at the oblique angle 260, in an assembled configuration within the housing 22. The illustrated embodiment of FIG. 12 is similar to the embodiment illustrated in FIG. 10 and includes similar elements and element numbers. For example, the second baffle 100 extends from the inlet panel 26 at the oblique angle 260, and the first baffle 80, fourth baffle 150, and fifth baffle 152 each extend from the second baffle 100 to the third baffle 140. Various elements of the terminal unit 20 are omitted from the illustrated embodiment to better illustrate the arrangement of the baffle system 68 within the internal volume 62 of the housing 22.

As similarly discussed above with reference to FIG. 7, each baffle 70 of the baffle system 68 may extend along the vertical axis 52. That is, each baffle 70 extends for a respective height 220 (e.g., dimension, vertical dimension) of the corresponding baffle 70, and the height 220 of each baffle 70 extends generally along the vertical axis 52. Similarly, the panels 60 of the housing 22 also extend along the vertical axis 52 by respective heights 222 (e.g., dimensions, vertical dimensions). In some embodiments, the height 220 of one or more baffles 70 may be approximately equal to the heights 222 of one or more panels 60. In other words, one or more baffles 70 may extend within the internal volume 62 from the top panel 240 to the bottom panel 242 of the housing 22 (e.g., along the vertical axis 52). However, in other embodiments such as the illustrated embodiment, the respective height 220 of one or more baffles 70 of the baffle system 68 may be less than the heights 222 of the panels 60 (e.g., side panels 142, 144, inlet panel 26) that define the housing 22. Accordingly, gaps or spaces 224 may extend between one or more of the baffles 70 and the top panel 240 or bottom panel 242.

As discussed above, any of the baffles 70 of the baffle system 68 may be offset from one or both of the top panel 240 and bottom panel 242 of the housing 22 (e.g., to define one or more corresponding gaps 224), such that the respective height 220 of the corresponding baffle 70 is less than the height 222 of the side panels 142, 144 and inlet panel 26. By positioning one or more of the baffles 70 at an offset distance from the top panel 240 or bottom panel 242 of the housing 22, one or more gaps 224 may be defined and may enable air flow therethrough, thereby reducing restriction of air flow (e.g., primary air flow 40, induced air flow 42) through the terminal unit 20. However, in some embodiments to may be desirable to include baffles 70 with heights 220 that are substantially equal to heights 222 of one or more panels 60 (e.g., side panels 142, 144, inlet panel 26) to enable increased attenuation of sound (e.g., via the baffles 70) generated within the housing 22.

Figure 13:
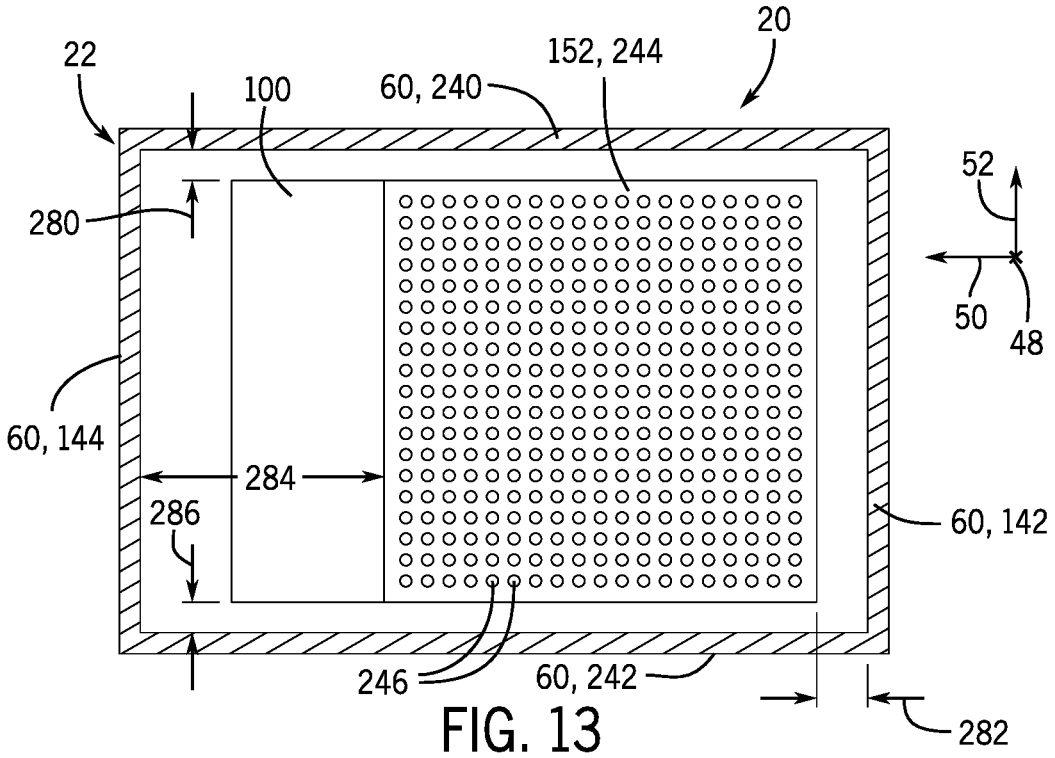
FIG. 13 is a schematic side section view of an embodiment of a terminal unit having a baffle system, in accordance with an aspect of the present disclosure.

FIG. 13 is an axial view schematic of an embodiment of the terminal unit 20, illustrating a relative location of the baffle system 68, including the second baffle 100 disposed at the oblique angle 260, within the internal volume 62 with respect to panels 60 of the housing 22. The illustrated embodiment includes similar elements and element numbers as the embodiment of FIG. 8 discussed above. As shown, the panels 60 may include the side panels 142 and 144, the top panel 240, and the bottom panel 242. In the illustrated embodiment, the fifth panel 152 is offset from the top panel 240 by a distance 280 (e.g., along vertical axis 52). Similarly, the fifth panel 152 is offset from the side panel 142 by a distance 282 (e.g., along lateral axis 50), is offset from the side panel 144 by a distance 284 (e.g., along lateral axis 50), and is offset from the bottom panel 242 by a distance 286 (e.g., along vertical axis 52). The distances 280, 282, and 286 by which the fifth panel 152 is offset from the housing 22 may define corresponding gaps through which air may flow, which may generally enable increased or less restrictive air flow through the terminal unit 20. As shown, the second baffle 100 extends from the fifth baffle 152 at least partially along the lateral axis 50, and the second baffle 100 is offset from the side panel 142 by a distance 288, which may be similar or equal in magnitude to the offset distance 266 discussed above with reference to FIG. 10. Respective magnitudes of the distances 280, 282, 284, and 286 may be selected to enable desirable positioning of the fifth panel 152 within the internal volume 62, enable desirable air flow through the housing 22, enable desirable attenuation of sound or noise generated by the terminal unit 20, or any combination thereof. Similarly, a magnitude of the distance 288 (e.g., offset distance 266) may be selected to enable desirable positioning of the second baffle 100 within the internal volume 62, enable desirable air flow through the housing 22, enable desirable attenuation of sound or noise generated by the terminal unit 20, or any combination thereof. It should be appreciated that corresponding positions of other baffles 70 of the baffle system 68 (e.g., relative to panels 60 of the housing 22) may be similarly selected to achieve the benefits described herein.

As will be appreciated, various configurations of the components described herein may be utilized in accordance with the present techniques. For example, the various baffles 70 of the baffle system 68 and/or components of the baffles 70 may be formed from single pieces of material or from multiple pieces of material. For instance, the panel 84 of the first baffle 80 (e.g., including the flange 114), the fourth baffle 150 (e.g., including the flange 154), and/or the fifth baffle 152 (e.g., including the flange 156) may each be formed from a single piece of material (e.g., non-perforated sheet metal, perforated sheet metal) and may be bent to define the corresponding flanges 114, 154, 156. In other embodiments, the flanges 114, 154, 156 may be separate components coupled to the corresponding panel 84 or baffle 150, 152. In some embodiments, one or more of the baffles 70 described herein may be formed as multiple separate baffles and/or two or more of the baffles 70 described herein may be combined to form a common baffle. As discussed above, baffles 70 having a perforated plate or panel may have various arrangements, sizes, cumulative areas (e.g., open areas) of perforations formed therein (e.g., relative to one another). One or more of the baffles 70 may be generally planar components or assemblies. Alternatively, one or more of the baffles 70 of the baffle system 68 may have a curved geometry (e.g., curved along the longitudinal axis 48, lateral axis 50, and/or vertical axis 52 in an installed configuration). In addition to, or instead of, the features described above, one or more of the baffles 70 may have various cuts, notches, or other features to enable a desirable arrangement of the baffle system 68 and/or coupling of the components of the baffle system 68 to one another and/or to the housing 22.

As set forth above, embodiments of the present disclosure may provide one or more technical effects useful for reducing noise emitted from a terminal unit of an HVAC system. Specifically, embodiments of the present disclosure are directed to a baffle system for a terminal unit including multiple baffles arranged within a housing of the terminal unit. The various baffles may include one or more of a solid (e.g., non-perforated panel), a perforated panel, one or more insulation layers, and/or other features that enable desirable positioning of the various baffles within the housing and relative to one another to enable desired air flow through the terminal unit while also reducing an amount of noise or sound output via the terminal unit during operation. In this way, the disclosed embodiments enable improved operation of the terminal unit and reduced noise output by the terminal unit. The technical effects and technical problems in the specification are examples and are not limiting. It should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A terminal unit of a heating, ventilation, and air conditioning (HVAC) system, comprising:

a first baffle configured to be disposed within the terminal unit and to receive and extend about an inlet duct of the terminal unit, wherein the first baffle comprises a panel and an insulation layer coupled to the panel; and a second baffle configured to be disposed within the terminal unit and to couple to an inlet panel of the terminal unit through which the inlet duct extends, wherein the inlet duct is configured to direct a first air flow into the terminal unit, the terminal unit comprises an opening configured to direct a second air flow into the terminal unit, and an end of the first baffle is configured to couple to the second baffle along a length of the second baffle between a base end of the second baffle configured to couple to the inlet panel and a distal end of the second baffle opposite the base end.

2. The terminal unit of claim 1, wherein the second baffle is configured to extend generally perpendicularly to the first baffle.

3. The terminal unit of claim 1, wherein the second baffle is configured to extend at an oblique angle relative to the first baffle.

4. The terminal unit of claim 1, comprising a third baffle configured to be disposed within the terminal unit downstream of the first baffle and the inlet duct relative to a direction of the first air flow through the inlet duct and into the terminal unit.

5. The terminal unit of claim 4, wherein the third baffle is a perforated panel.

6. The terminal unit of claim 4, comprising a fourth baffle configured to be disposed within the terminal unit downstream of the third baffle relative to the direction of the first air flow through the inlet duct and into the terminal unit.

7. The terminal unit of claim 6, wherein the third baffle is a perforated panel, and the fourth baffle is an additional perforated panel.

8. The terminal unit of claim 6, wherein the third baffle and the fourth baffle are each configured to couple to the second baffle.

9. The terminal unit of claim 8, comprising a fifth baffle configured to be disposed within the terminal unit and to couple to the inlet panel of the terminal unit through which the inlet duct extends, wherein the first baffle, the third baffle, and the fourth baffle are each configured to couple to the fifth baffle.

10. The terminal unit of claim 9, wherein the first baffle, the third baffle, and the fourth baffle are each configured to extend generally parallel with one another.

11. The terminal unit of claim 9, wherein the fifth baffle is a perforated panel.

12. The terminal unit of claim 1, wherein the panel is a first panel, the insulation layer is a first insulation layer, and the second baffle comprises a second panel, a second insulation layer coupled to a first side of the second panel, and a third insulation layer coupled to a second side of the second panel.

13. A terminal unit of a heating, ventilation, and air conditioning (HVAC) system, comprising:

a housing comprising a plurality of housing panels defining an internal volume;

an inlet duct extending through a housing panel of the plurality of housing panels and into the internal volume, wherein the inlet duct is configured to direct a first air flow into the internal volume; and a baffle system disposed within the internal volume, wherein the baffle system comprises a first baffle including a panel and an insulation layer coupled to the panel, and the baffle system comprises a second baffle coupled to the housing panel, wherein an end of the first baffle is coupled to the second baffle along a length of the second baffle between a base end of the second baffle coupled to the housing panel and a distal end of the second baffle opposite the base end, wherein the housing comprises an opening configured to direct a second air flow into the internal volume.

14. The terminal unit of claim 13, wherein the inlet duct extends into the first baffle, and the first baffle is offset from the housing panel.

15. The terminal unit of claim 13, wherein the panel is a first panel, the insulation layer is a first insulation layer, the second baffle comprises a second panel, a second insulation layer coupled to a first side of the second panel, and a third insulation layer coupled to a second side of the second panel, the inlet duct extends into the internal volume along an axis, and the second baffle extends within the internal volume along the axis.

16. The terminal unit of claim 13, wherein the panel is a first panel, the insulation layer is a first insulation layer, the second baffle comprises a second panel, a second insulation layer coupled to a first side of the second panel, and a third insulation layer coupled to a second side of the second panel, the inlet duct extends into the internal volume along an axis, and the second baffle extends within the internal volume at an oblique angle relative to the axis.

17. A terminal unit of a heating, ventilation, and air conditioning (HVAC) system, comprising:

a housing comprising a plurality of housing panels defining an internal volume;

an inlet duct extending through a first housing panel of the plurality of housing panels and into the internal volume, wherein the inlet duct is configured to direct a first air flow into the internal volume;

an opening formed in a second housing panel of the plurality of housing panels, wherein the opening is configured to direct a second air flow into the internal volume; and a baffle system disposed within the internal volume, wherein the baffle system comprises:

a first baffle coupled to the inlet duct and extending about the inlet duct, wherein the first baffle comprises a baffle panel and an insulation layer coupled to the baffle panel;

a second baffle coupled to the first housing panel and the first baffle, wherein an end of the first baffle is coupled to the second baffle along a length of the second baffle between a base end of the second baffle coupled to the first housing panel and a distal end of the second baffle opposite the base end; and a third baffle coupled to the distal end of the second baffle, wherein the third baffle is disposed downstream of the first baffle relative to a direction of the first air flow through the inlet duct and into the internal volume, and the third baffle comprises a perforated plate.

18. The terminal unit of claim 17, wherein the second baffle extends from the first housing panel at an oblique angle, and the second baffle overlaps with the opening relative to an axis extending crosswise to the direction of the first air flow.

19. The terminal unit of claim 1, wherein the panel of the first baffle comprises a flange configured to secure the first baffle to the second baffle via a mechanical fastener extending through the flange.

* * * * *